US006963407B2

(12) United States Patent
Abe et al.

(10) Patent No.: US 6,963,407 B2
(45) **Date of Patent: *Nov. 8, 2005**

(54) PROCESS END POINT DETECTION APPARATUS AND METHOD, POLISHING APPARATUS, SEMICONDUCTOR DEVICE MANUFACTURING METHOD, AND RECORDING MEDIUM RECORDED WITH SIGNAL PROCESSING PROGRAM

(75) Inventors: Hiroyuki Abe, Yokohama (JP); Takehiko Ueda, Tokyo (JP)

(73) Assignee: Nikon Corporation, Tokyo (JP)

( * ) Notice: Subject to any disclaimer, the term of this patent is extended or adjusted under 35 U.S.C. 154(b) by 583 days.

This patent is subject to a terminal disclaimer.

(21) Appl. No.: 09/819,977

(22) Filed: Mar. 29, 2001

(65) Prior Publication Data

US 2003/0205664 A1 Nov. 6, 2003

Related U.S. Application Data

(63) Continuation-in-part of application No. 09/316,082, filed on May 20, 1999, now Pat. No. 6,271,047.

(30) Foreign Application Priority Data

Mar. 29, 2000 (JP) ..... 2000-090427
Aug. 2, 2000 (JP) ..... 2000-234219

(51) Int. Cl.[7] ..... G01B 9/02; G01B 11/28

(52) U.S. Cl. ..... 356/503; 356/630

(58) Field of Search ..... 356/485, 492, 356/496, 503, 630; 250/599.19, 599.27

(56) References Cited

U.S. PATENT DOCUMENTS 5,658,183 A * 8/1997 Sandhu et al. ..... 451/5
6,111,634 A 8/2000 Pecen et al.
6,271,047 B1 * 8/2001 Ushio et al. ..... 438/14

FOREIGN PATENT DOCUMENTS

JP 2000-040680 2/2000
KR 2000-41422 A 7/1998

* cited by examiner

*Primary Examiner*—Gregory J. Toatley, Jr.
*Assistant Examiner*—Patrick Connolly
(74) *Attorney, Agent, or Firm*—Morgan, Lewis & Bockius LLP

(57) ABSTRACT

A detection apparatus for detecting the process end point in the removal process of a layer on a wafer in an IC or other semiconductor device manufacturing process. This point can be detected in-situ and at high precision even when there is a pattern on the surface, or when there is no distinct change in the polishing layer, or when there is disturbance caused by a difference in the detection position or the slurry. Two or more characteristic quantities are extracted from a signal waveform obtained by irradiating a substrate surface with white light and detecting the reflected signal light or the transmitted signal light or both, fuzzy rules, etc., are used in performing detection by using these two or more characteristic quantities to perform a logical operation, and tuning is performed.

24 Claims, 18 Drawing Sheets

(a) No slurry (b) Low slurry concentration (c) High slurry concentration

PROCESS END POINT DETECTION APPARATUS AND METHOD, POLISHING APPARATUS, SEMICONDUCTOR DEVICE MANUFACTURING METHOD, AND RECORDING MEDIUM RECORDED WITH SIGNAL PROCESSING PROGRAM

The present application is a Continuation-In-Part of application Ser. No. 09/316,082, filed May 20, 1999, now U.S. Pat. No. 6,271,047.

This application claims the benefit of Japanese Patent Application Nos. 2000-090427, filed on Mar. 29, 2000, and 2000-234219, filed on Aug. 2, 2000, which are both hereby incorporated by reference.

BACKGROUND OF THE INVENTION

1. Field of the Invention

The present invention relates to a detection apparatus for detecting the process end point in a process of forming a layer on a semiconductor wafer, or a process of removing the layer on a wafer, such as a polishing process, in a process of manufacturing a semiconductor device such as an integrated circuit; a detection method; a polishing apparatus; a method for manufacturing a semiconductor device; and a recording medium on which is recorded a detection method program.

2. Discussion of the Related Art

The trend toward higher density in semiconductor devices is continuing with no end in sight, and various techniques and methods are being developed in an effort to achieve higher density. One of these is multilayer wiring, and related technological issues include the planarization of a global device face (over a relatively large area) of a semiconductor wafer, and wiring between upper and lower layers.

Taking into account the reductions in exposure light wavelength in lithography, as well as the reductions in focal depth during exposure attendant to high NA (Numerical Aperture), there is a great need for precision in the planarization of interlayers, at least around the exposure area. There is also a great need for so-called inlaying (plugging, damascene process), in which a metal electrode layer is inlaid in order to achieve multilayer wiring, in which case any extra part of the metal layer must be removed and planarized after the lamination of the metal layer. A polishing process called CMP has been remarked as an efficient technique for planarizing large areas. CMP (Chemical Mechanical Polishing or Planarization) makes use of both a physical polishing action and a chemical polishing action (dissolving out with a solution of a polishing agent), and is the best candidate for a technique that will allow global planarization and electrode formation in the process of removing the surface layer of a wafer. In specific terms, polishing agents called slurry are produced by dispersing polishing grit (generally silica, alumina, cerium oxide, or the like) in acid, alkali, or another solvent capable of dissolving the material to be polished, and using this slurry, pressure is applied to the wafer surface with a suitable polishing pad, and polishing is carried out by rubbing with relative motion. Uniform polishing within a plane is possible by keeping the pressure and relative motion speed constant over the entire wafer surface.

FIG. 12 is a simplified diagram of a conventional CMP polishing apparatus. A wafer 2 placed on a polishing head 1 is pressed against a polishing pad 3 while rotating at an angular velocity $\grave{u}_H$. A platen 4 to which the polishing pad is fixed rotates at an angular velocity $\grave{u}_H$. A polishing agent (slurry) 17 is supplied in between the wafer 2 and the polishing pad 3 from a polishing agent supply equipment 16, and the polishing surface of the wafer 2 is polished by the chemical and mechanical actions of the slurry 17 and the polishing pad 3. The polishing velocity v at any point within the wafer 2 plane is expressed by $v=r_C\cdot\omega_T-r_H\cdot(\omega_H-\omega_T)$ (where $r_C$ is the distance from the center of the platen 4 to the center of the polishing head 1, and $r_H$ is the distance from the center of the polishing head 1 to the polishing point). Therefore, when $\omega_H=\omega_T$, the polishing rate is constant regardless of the position within the wafer 2.

An important requirement in this process is the detection of the end point of the polishing process. Detecting the polishing end point while the polishing process is underway (in-situ) is especially important in terms of process efficiency.

As to this detection method, a standard film thickness measurement apparatus is frequently used to detect the end point of the polishing process. Detection and measurement are performed by a variety of methods, selecting a microscopic blank portion of the washed wafer after the process (the places without a device pattern) as the measurement site.

A faster monitoring method in the polishing and planarizing process is to detect the frictional fluctuations when the polishing moves to another layer than the layer that is supposed to be polished, by means of the changes in the motor torque of the wafer rotation or pad rotation.

In addition, there is a method in which the wafer face is irradiated with laser light, and the film thickness is measured by utilizing optical interference to track fluctuations in the reflected light intensity over time. There are numerous methods in which changes in intensity are tracked over time and the end point is deemed to be the point when a specific value is reached, but because of effects such as signal noise and error in the measurement position and uncertainty dependent on the device pattern of the wafer, it is considered to be difficult to clearly determine the process end point.

There are various methods for detecting the end point in a CMP process, as discussed above, but a method that can be considered definitive has yet to be found.

For instance, measurement with a film thickness measurement apparatus does provide sufficient precision and reliable data, but the apparatus itself is bulky, measurement takes a long time, and feedback to the process is slow.

A method in which the process end point is detected from motor torque is convenient and fast, but it is only effective in detecting the process end point when there is a clear change in the layer to a different type; furthermore, its precision is inadequate.

Meanwhile, a method in which the wafer face is irradiated with laser light is hampered by error in the measurement position and uncertainty dependent on the type of device pattern of the wafer, and by the effect of signal noise originating in the slurry and so on, and these combine to disturb the signal, so it is held to be difficult to clearly determine the process end point.

The present invention solves the above-mentioned problems and provides an apparatus for detecting the polishing end point, with which this point can be detected simultaneously with the polishing (in-situ) even when the signal is disturbed and when the polishing layer does not clearly change to a different type; a detection method; a polishing apparatus; a method for manufacturing a semiconductor device; and a recording medium on which is recorded a detection method.

SUMMARY OF THE INVENTION

In order to solve the above-mentioned problems, a first aspect of the present invention provides a detection apparatus for detecting a process end point in a layer formation process for forming a metal electrode layer or an insulating layer on a substrate, or in a removal process for said layer, from a signal waveform obtained by irradiating the substrate face with light and detecting the reflected signal light or the transmitted signal light or both; this detection apparatus being characterized by the fact that it comprises a characteristic quantity extraction component for extracting two or more characteristic quantities from the signal waveform, and a logical operation component for using the two or more characteristic quantities to perform a logical operation and determine the process end point.

The detection performed by the detection apparatus in this means is primarily the detection of a process end point.

A second aspect of the present invention provides a detection apparatus wherein the signal waveform is a spectral waveform, and the characteristic quantities are selected from a characteristic quantity group consisting of a group of local maxima in the signal waveform, the largest local maximum, local minima, the smallest local minimum, local maximum/local minimum values, the largest local minimum/the smallest local minimum, |local maximum−local minimum| (absolute value) for adjacent local maximum/local minimum pairs, a sum of various |local maximum−local minimum| for a plurality of local maximum/local minimum pairs, an integral value of the signal waveform, and one-time and two-time time differential coefficients for each of the characteristic quantities, and a group of positive and negative signs of the time differential coefficients.

A third aspect of the present invention provides a detection apparatus wherein the logical operation component makes its determination using fuzzy logic.

A fourth aspect of the present invention provides a detection apparatus wherein the membership functions used in the fuzzy logic are tuned during detection by means of the values computed from the characteristic quantities.

A fifth aspect of the present invention provides a detection apparatus for detecting a process end point in a layer formation process for forming a metal electrode layer or an insulating layer on a substrate, or in a removal process for said layer, from the change in a characteristic quantity extracted from a signal waveform obtained by irradiating the substrate face with light and detecting the reflected signal light or the transmitted signal light or both; this detection apparatus comprises a characteristic quantity extraction component for extracting a characteristic quantity from the signal waveform, wherein the signal waveform is a spectral waveform, and wherein the characteristic quantity is |local maximum−local minimum| for adjacent local maximum/local minimum pairs in the signal waveform, or a sum of various |local maximum−local minimum| for a plurality of local maximum/local minimum pairs, or an integral value of the signal waveform.

A sixth aspect of the present invention provides a detection apparatus wherein the characteristic quantities are extracted from a waveform in which the signal waveform has been normalized.

A seventh aspect of the present invention provides a detection apparatus wherein the characteristic quantities are extracted from a waveform in which the signal waveform has undergone rotational correction.

An eighth aspect of the present invention provides a detection method for detecting a process end point in a layer formation process for forming a metal electrode layer or an insulating layer on a substrate, or in a removal process for said layer, from a signal waveform obtained by irradiating the substrate face with light and detecting the reflected signal light or the transmitted signal light or both; this detection method comprises a stage in which two or more characteristic quantities are extracted from the signal waveform, and a stage in which the two or more characteristic quantities are used to perform a logical operation and determination.

A ninth aspect of the present invention provides a detection method for detecting a process end point in a layer formation process for forming a metal electrode layer or an insulating layer on a substrate, or in a removal process for said layer, from the change in a characteristic quantity extracted from a signal waveform obtained by irradiating the substrate face with light and detecting the reflected signal light or the transmitted signal light or both; in this detection method the signal waveform is a spectral waveform, and the characteristic quantity is |local maximum−local minimum| for adjacent local maximum/local minimum pairs in the signal waveform, or a sum of various |local maximum −local minimum| for a plurality of local maximum/local minimum pairs, or an integral value of the signal waveform.

Here, the local maximum/local minimum and the largest local maximum/smallest local minimum in the second, fifth, and ninth means respectively indicate the quotient of dividing a local maximum by a local minimum, and the quotient of dividing the largest local maximum by the smallest local minimum, while the |local maximum−local minimum| indicates an absolute value of the value obtained by subtracting a local minimum from a local maximum.

A tenth aspect of the present invention provides a polishing apparatus which is equipped with a holder for holding a substrate, a polishing body, and a detection apparatus of the present invention to detect a process end point when the substrate is polished by applying a load between the substrate and the polishing body and causing relative motion between the two in a state in which a polishing agent has been interposed between the substrate and the polishing body, wherein the polishing body means any of a polishing cloth, a polishing sheet, a polishing pad and so forth on.

An eleventh aspect of the present invention provides a method for manufacturing a semiconductor device comprising a stage in which a polishing apparatus of the present invention is used to polish the surface of a semiconductor wafer.

A twelfth aspect of the present invention provides a machine readable recording medium on which is recorded a signal processing program for causing a computer to function as a characteristic quantity extraction component and a logical operation component, or just a characteristic quantity extraction component, of the present invention.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

The present invention attempts to perform the optical measurement of a thin layer on a wafer in order to detect a process end point.

Various methods are known for optically measuring the thickness of a thin film layer, and fairly good precision has been achieved in methods that make use of interference phenomena. All of these, however, are for measuring blank films (including multilayer films). An aspect of the present invention is not only blank films, but also substrates (wafers) on which device patterns (under patterns) have been formed, and portions that are not two-dimensionally uniform as with a blank film. In this case, a signal simply estimated from a blank film is not obtained.

In view of this, the present invention makes use of a light source with multiple wavelength components for measurement, and performs this measurement by irradiating a wafer with light of multiple wavelength components and analyzing the wavelength dependency, that is, the spectral characteristics, of the reflected light. A white light source is preferable as this light source with multiple wavelength components. When a white light source is used, the irradiation may be with the white light directly, or this light may be separated into components and the irradiation carried out over time. Furthermore, this white light source may be a light source that emits light in a plurality of spectra of relatively narrow half width, rather than an ordinary light source that continuously emits light of a relatively wide spectrum, and it may also be an infrared light source, or an ultraviolet light source.

The irradiation method will be described herein as a method in which the irradiation is performed from the side of the wafer to be polished, but is not limited to this, and by using a light source of multiple wavelength components in the infrared band, it is also possible to adopt a method in which the irradiation is performed from the back of the wafer (side that is facing the side to be polished) (in which case either the reflected light or the transmitted light may be detected).

Figure 14:
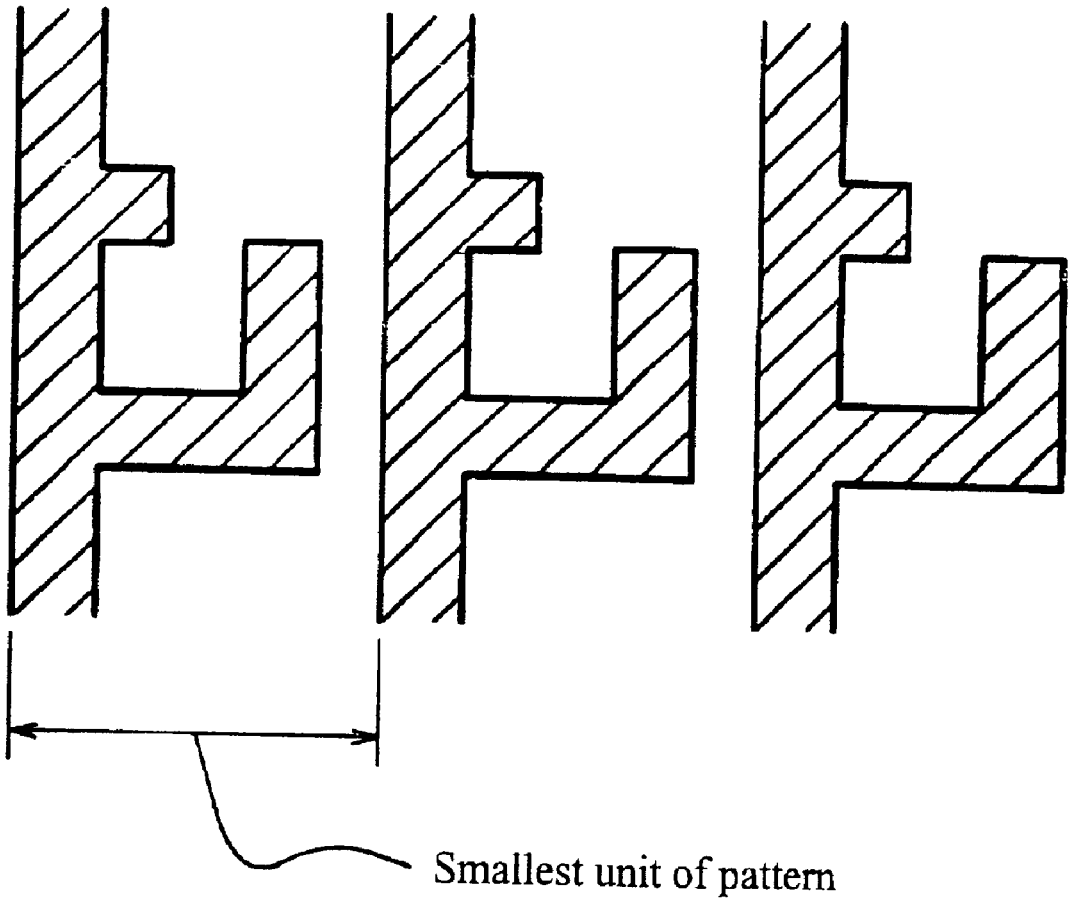
FIG. 14 is a diagram of the smallest unit of a pattern.

The spot diameter of the irradiating light is preferably larger than the smallest unit of the pattern. If so, the waveform of the spectral characteristics will be very different from that of a blank film because of the complex interference effect. The phrase "smallest unit of the pattern" as used here is the smallest repeating unit of a pattern having a periodic structure, as shown in the one-dimensional direction with respect to the pattern shown in simplified plan view in FIG. 14, for example.

Examples of the present invention will be described below in detail with reference to the figures.

Figure 1:
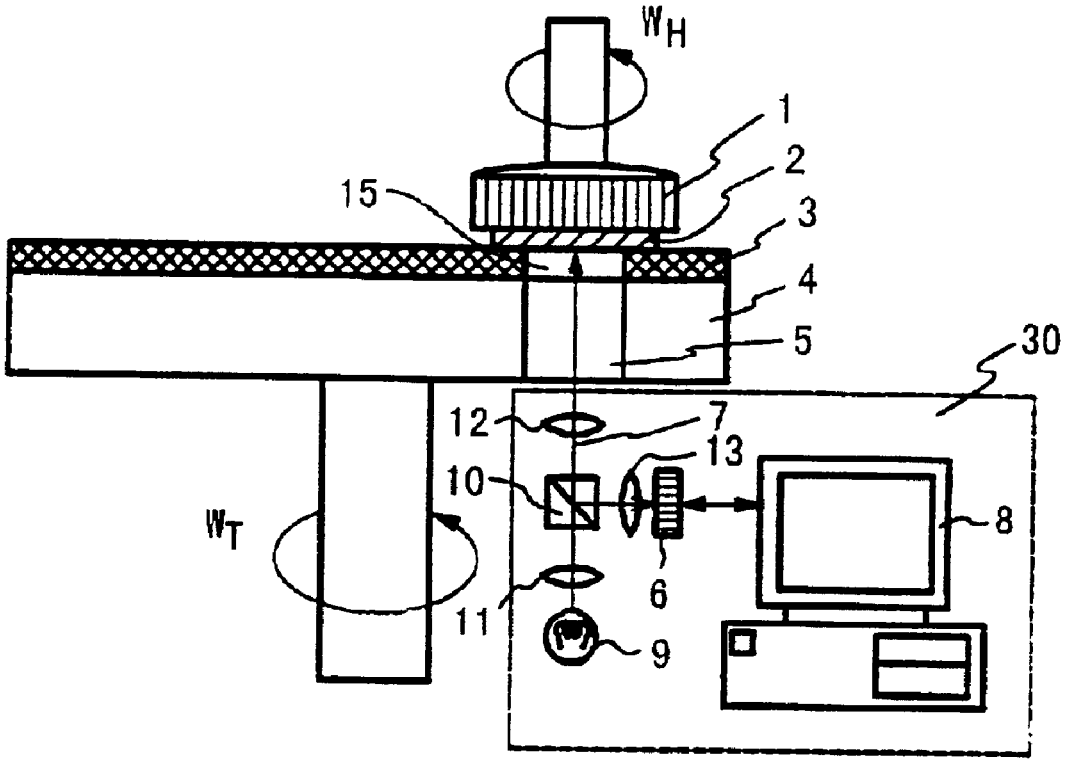
FIG. 1 is a simplified diagram of the CMP polishing apparatus of the present invention.

FIG. 1 is a simplified diagram of a CMP polishing apparatus for illustrating the present invention. A light window 5 is provided to the polishing pad 3 and the platen 4, which makes it possible for the irradiating light and the reflected signal light to be transmitted to the side of the wafer being polished, but everything else is the same as in the conventional CMP polishing apparatus in FIG. 12, so the operation of the polishing itself will be omitted in order to avoid redundancy.

Figure 12:
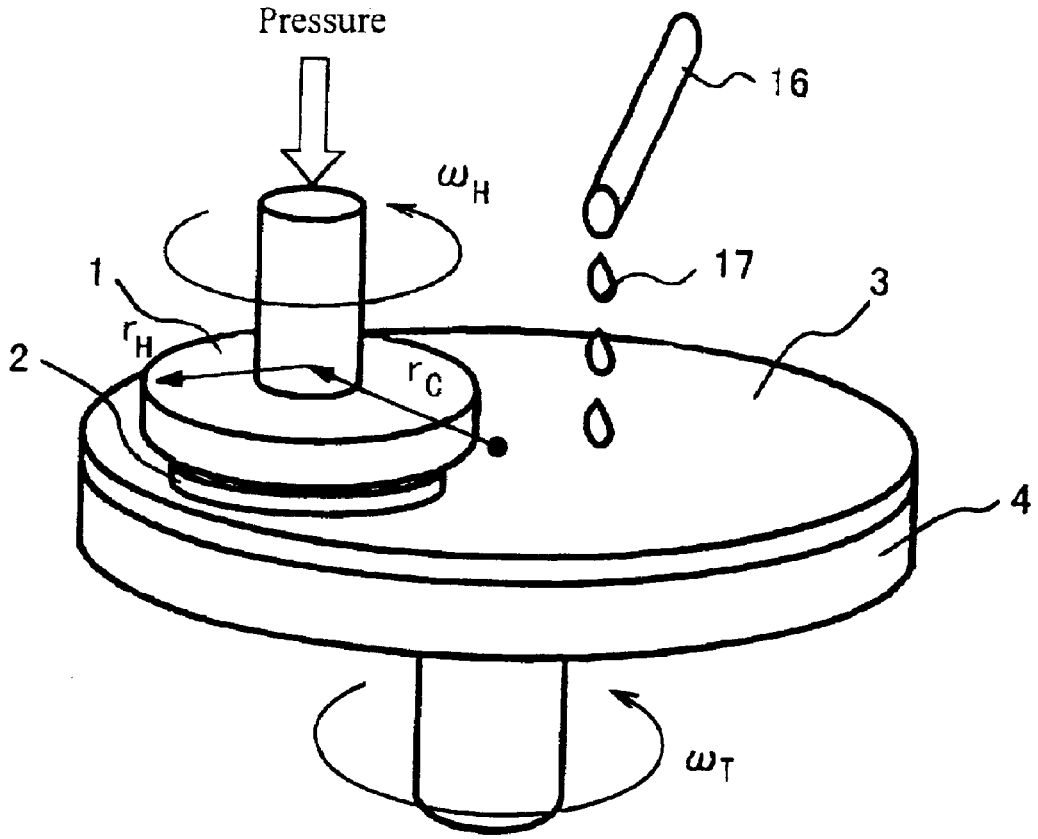
FIG. 12 is a simplified diagram of a conventional CMP polishing apparatus.

The polishing apparatus in FIG. 1 polishes the polishing face of the wafer 2 through the operation described for the polishing apparatus in FIG. 12. With the present invention, a polishing end point detection apparatus 30 detects the polishing end point during polishing.

The polishing end point detection apparatus indicated by 30 in FIG. 1 comprises a white light source 9, lenses 11 to 13, a beam splitter 10, a light receptor 6, and a signal processor 8. Here, a xenon lamp, a halogen lamp, a tungsten lamp, a white LED, etc., can be used as the white light source. The beam splitter 10 is preferably an amplitude splitting type using an optical thin film layer, and the window material is preferably a non-polarizing type so as to reduce the adverse effect that the birefringence normally had on the detection. Furthermore, a computer is preferably used as the signal processor 8.

The irradiating light emitted from the white light source passes through the lens 11, the beam splitter 10, the lens 12, and the light window 5, and irradiates the polishing side of the wafer 2. A transparent window material 15 is preferably fitted into the light window 5, and a polycarbonate, acrylic, or the like is used for this material. The reflected signal light from the wafer 2 passes back through the lens 12, reflects off the beam splitter 10, passes through the lens 13, and is received by the light receptor 6. The light receptor 6 sends an optical signal corresponding to the reflected signal light to the signal processor 8. This signal processor 8 comprises a characteristic quantity extraction component and a logical operation component.

Figure 5:
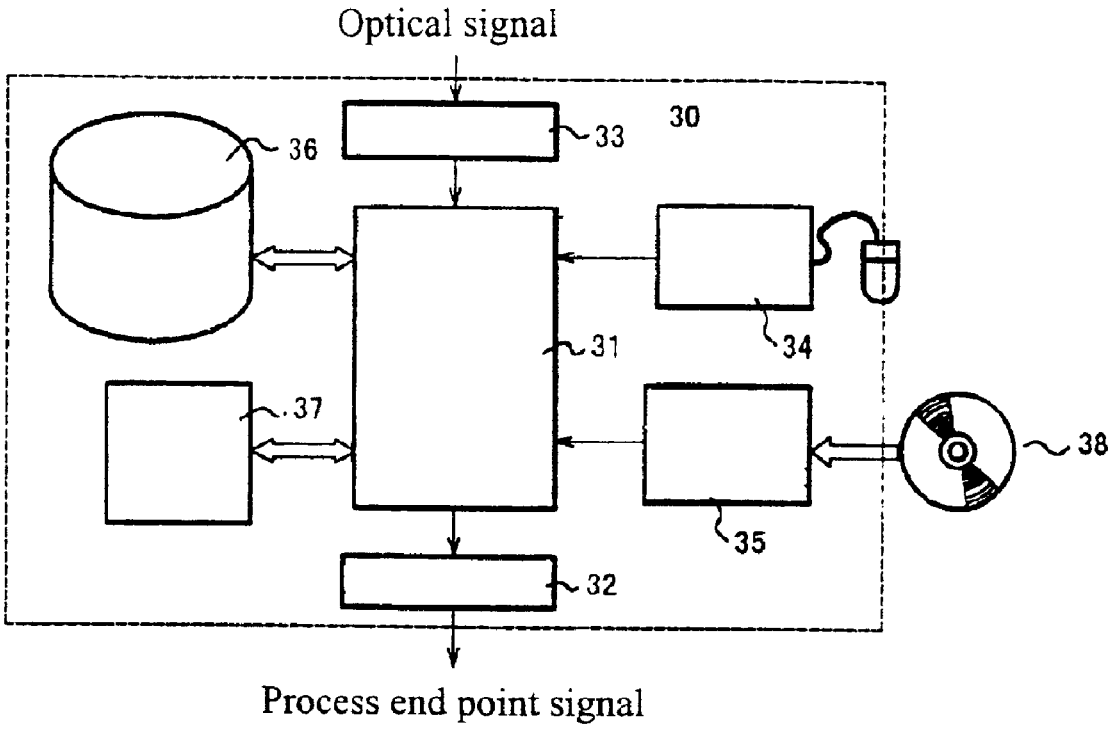
FIG. 5 is a diagram of a signal processor that makes use of a computer.

FIG. 5 shows the structure of a signal processor when a computer is used as the signal processor.

In FIG. 5, a CPU (Central Processing Unit) 31 is provided inside a computer 30, and the CPU 31 is connected to an input device 34 (consisting of a keyboard or a mouse), a hard disk 36, a memory 37, an interface board 33, and an interface board 32. If needed, the CPU 31 is also connected to a monitor device.

A CD-ROM drive 35 is also connected to the CPU 31, and when a CD-ROM 38 on which a signal processing program and the installation program therefor are recorded is inserted into this CD-ROM drive 35, the CPU 31 uses the installation program to open the signal processing program and store it in an executable state on the hard disk 36. When the medium on which the program is recorded is a floppy disk, a floppy disk drive is used instead of the CD-ROM drive 35.

Figure 16:
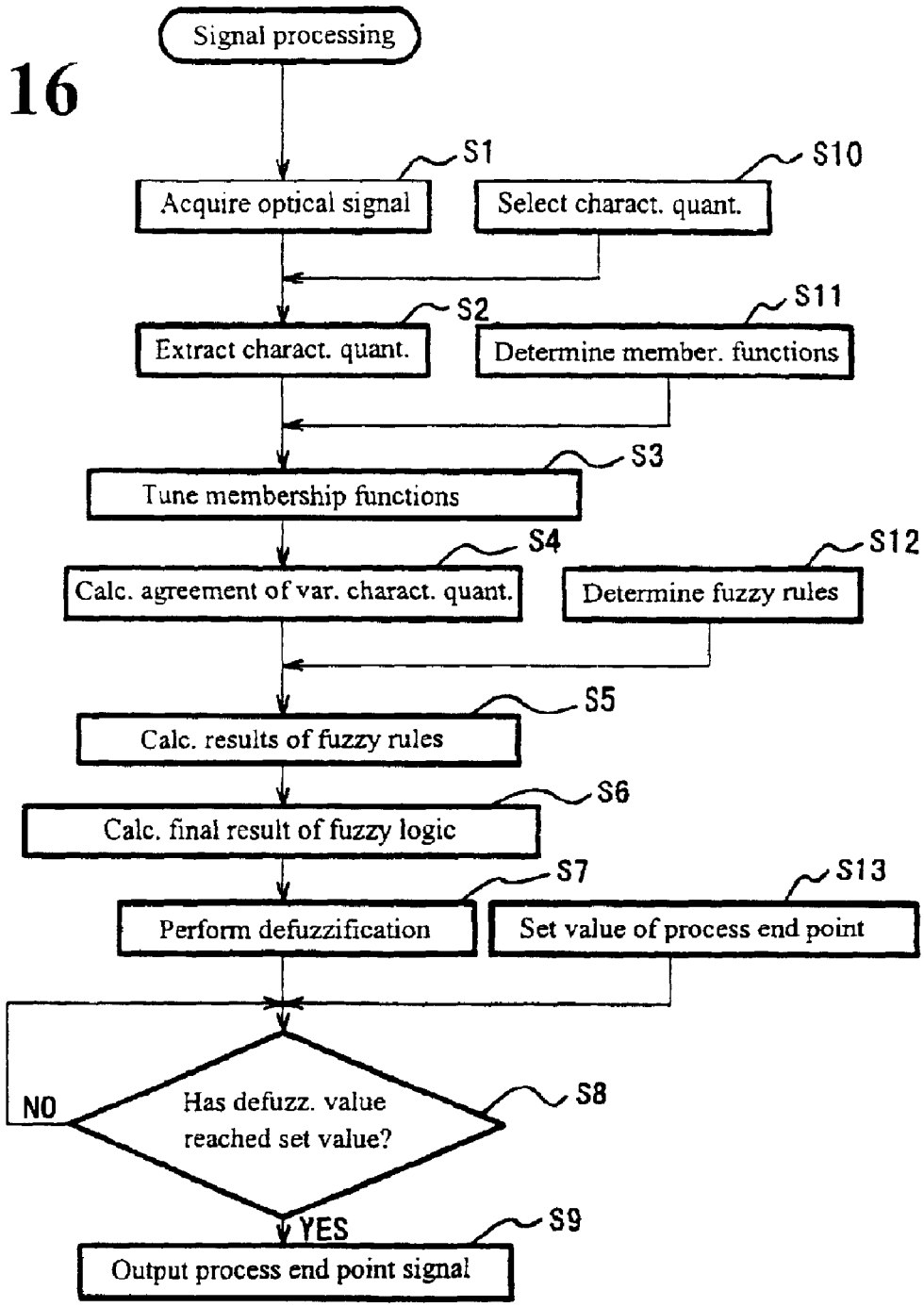
FIG. 16 is a flow chart of a working configuration of signal processing by fuzzy logic.
Figure 17:
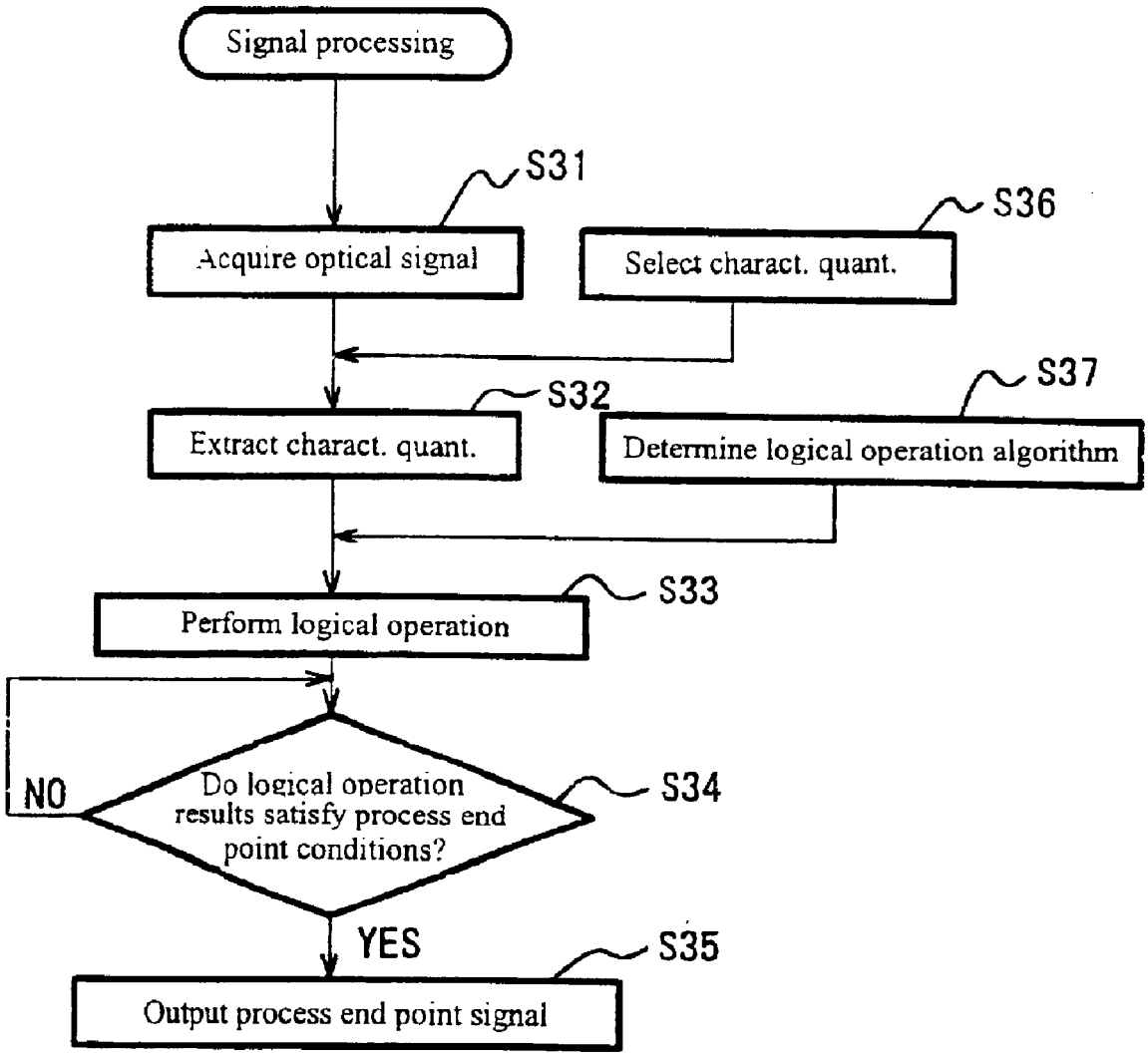
FIG. 17 is a flow chart of a working configuration of signal processing by logical operation.
Figure 18:
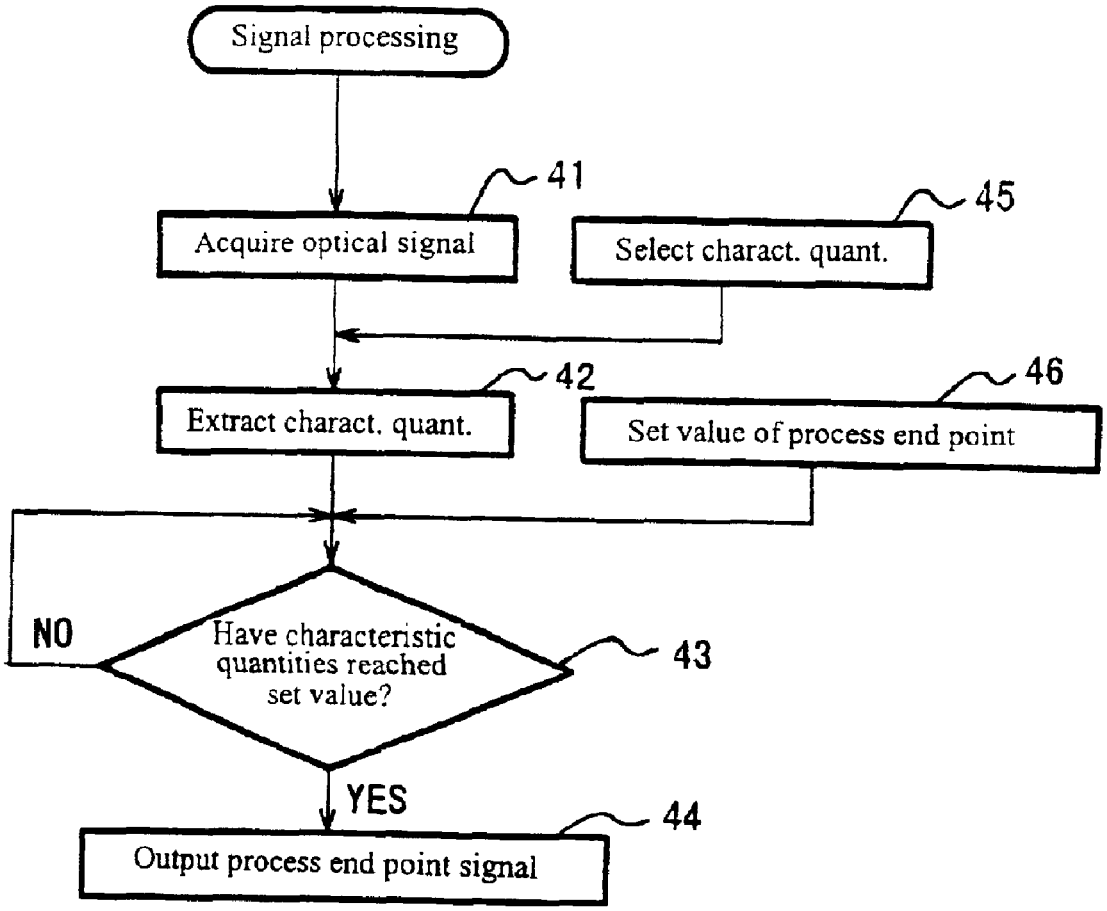
FIG. 18 is a flow chart of a working configuration of signal processing by changes in characteristic quantities.

When a computer is used as the signal processor, the characteristic quantities extraction component corresponds in S2 of FIG. 16, S32 of FIG. 17, and S42 of FIG. 18 to the CPU 31 functioning to extract characteristic quantities, and the logical operation component corresponds in FIG. 16 to the CPU 31 functioning to perform tuning of the membership functions (S3), calculate the agreement of the various characteristic quantities (S4), calculate the results of the individual fuzzy rules (S5), calculate the final results of the fizzy logic (S6), perform defuzzification (S7), and determine whether the value of the defuzzification has reached the set value (S8) Furthermore, the logical operation component corresponds in FIG. 17 to the CPU 31 functioning to perform a logical operation on the basis of a logical operation algorithm (S33), and determine whether the logical operation result satisfies the process end point conditions (S34).

Figure 2:
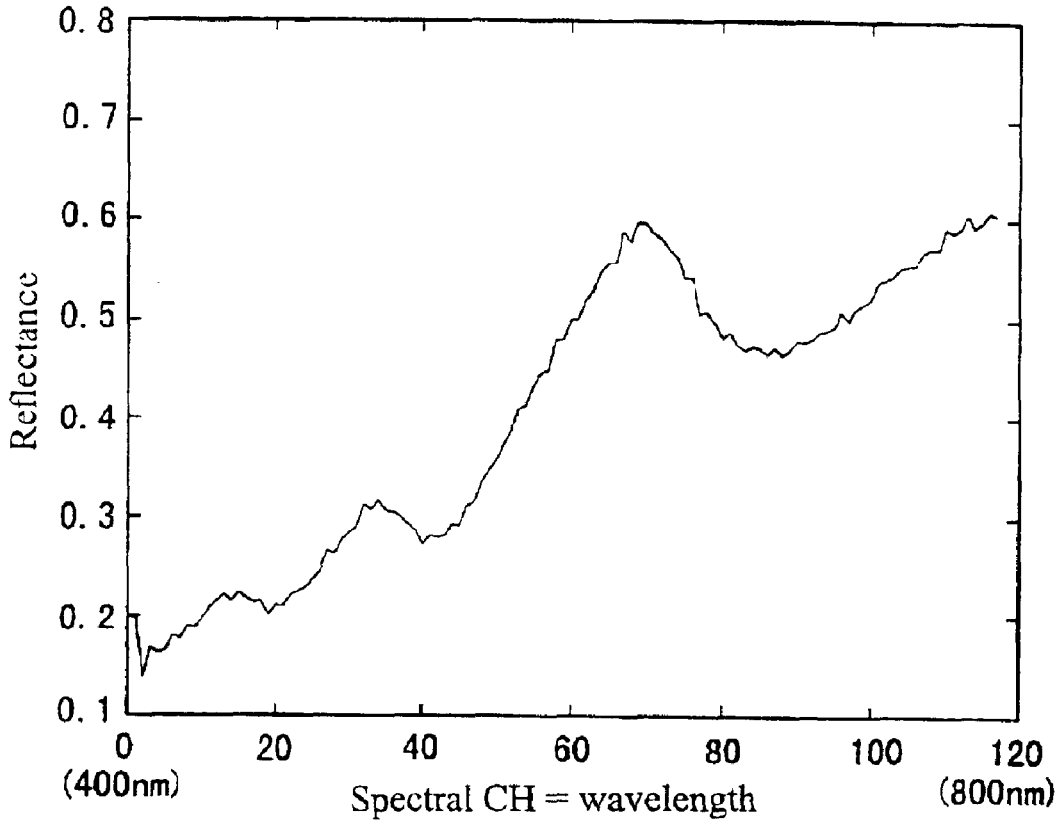
FIG. 2 is an example of a signal waveform (spectral waveform).

FIG. 2 is an example of the waveform of the optical signal. This optical signal is a spectral signal, and the horizontal axis indicates the spectroscope (not shown in the figures) channel (in FIG. 2, 117 channels or a wavelength of 420 to 800 nm), while the vertical axis indicates the reflectance. To obtain this spectral signal, either light from which the reflected signal light has been separated must be received, or light from which white light has been separated must be used as the irradiating light, but the spectroscope is not shown in FIG. 1. As can be seen by referring to FIG. 1, since the platen 4 is rotating, the light window 5 also rotates with respect to the wafer 2 or the irradiating light axis, and a signal waveform as shown in FIG. 2 is obtained every time the light window 5 comes around to the position of the irradiating light (usually once for every rotation of the platen 4). In the present invention, the process end point is determined on the basis of this signal waveform.

Figure 3:
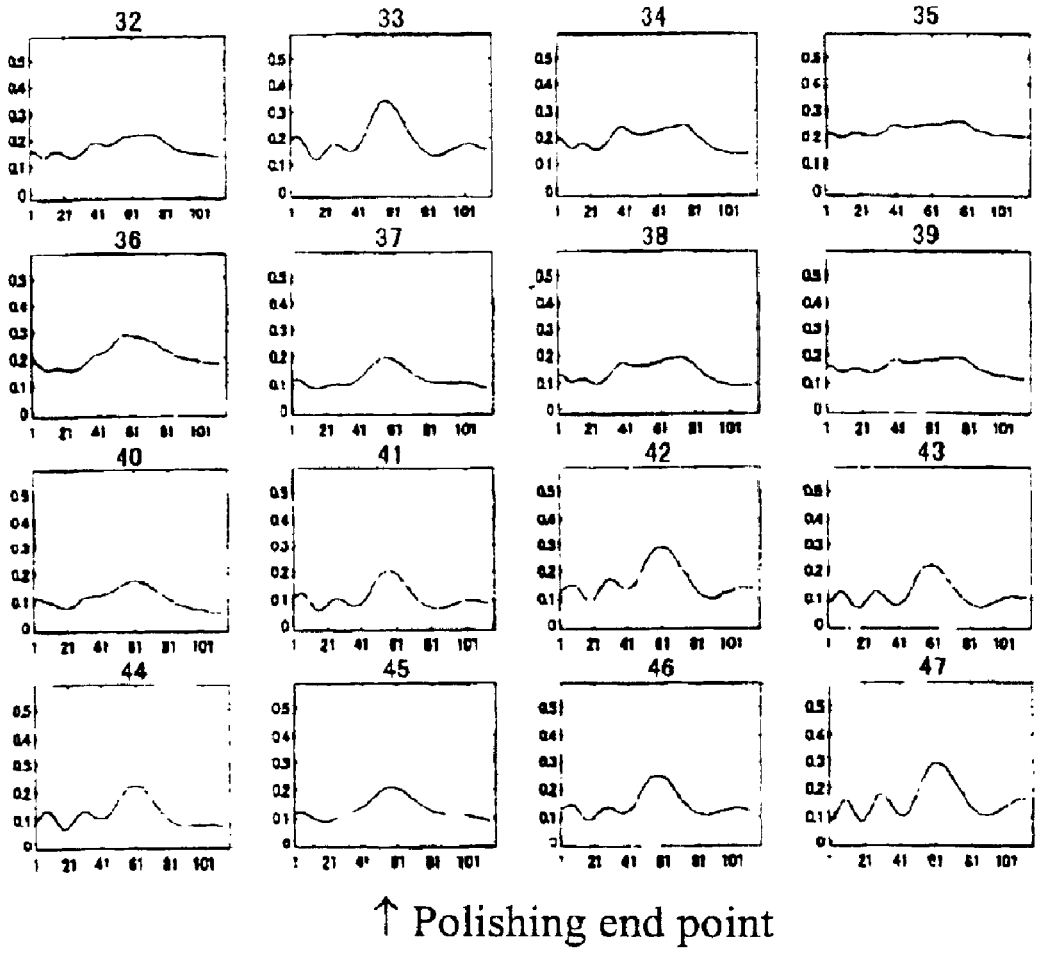
FIG. 3 is an example of the continuous display of a signal waveform (spectral waveform).

As can be seen from FIG. 2, the signal waveform includes many noise elements. Accordingly, the signal waveform is subjected to smoothing as a pretreatment. FIG. 3 shows 16 examples of signal waveforms after this smoothing treatment. These 16 examples are signal waveforms acquired consecutively every time the platen 4 made one rotation when a wafer having a pattern of a certain type of device was polished. The horizontal axis is the wavelength, while the vertical axis is the reflectance. A signal waveform acquisition number (hereinafter referred to as "signal number") is indicated at the top center of each signal waveform graph. Therefore, FIG. 3 shows consecutive signal numbers from No. 32 (upper left) to No. 47 (lower right). The polishing end point in these examples is at the point of signal No. 45. As can be seen from a comparison of this signal No. 45 to signal Nos. 44 and 46 immediately before and after, no clear distinction can be made between these signals. It is not that a device wafer with which the polishing end point is particularly difficult to make out was selected, and a signal change is generally not very pronounced before and after the polishing end point. It is known from experience that this change is extremely subtle and vague.

Thus, to get a good grasp on an extremely vague and subtle signal change, the first step in the present invention is to extract a suitable characteristic quantity from the signal waveform, and detect the polishing end point on the basis of the change in this characteristic quantity. Furthermore, the polishing end point is detected by means of a logical operation combining a plurality of these characteristic quantities.

Figure 4:
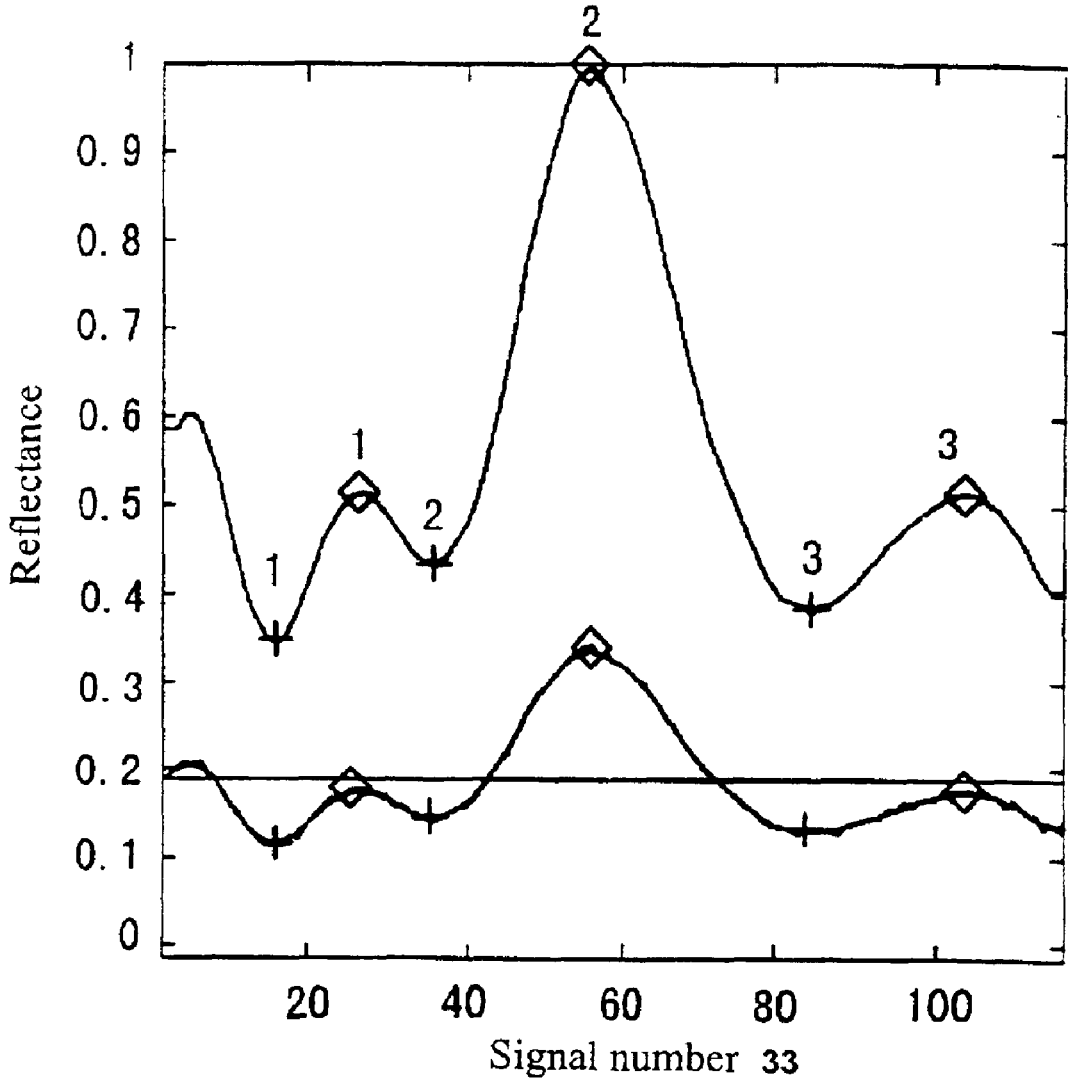
FIG. 4 is a diagram illustrating the relationship between a signal waveform, a normalized signal waveform, and characteristic quantities.

FIG. 4 shows two signal waveforms that illustrate these characteristic quantities. These signal waveforms are spectral waveforms, and the lower curve corresponds to signal No. 33 in FIG. 3. The local maximum and local minimum are selected here as the characteristic quantities, and on these signal waveforms the local maximum is indicated by diamond shapes, and the local minimum by plus signs. The local maximum and local minimum can be calculated (extracted) by subjecting the signal waveform to smoothing differentiation. The positions (wavelength and reflectance) of the local maximum and local minimum become characteristic quantities, but in this embodiment reflectance was used. In the extraction of these characteristic quantities, the size of the signal waveform is preferably normalized. This normalization is performed in order to reduce the effect of disturbance components on the signal, which can fluctuate regardless of fluctuations in irradiation light source intensity, fluctuations in the transmittance of the optical system consisting of lenses and so forth, fluctuations in the reception sensitivity of the receptor, fluctuations in the slurry, and other such changes in the polishing state of the wafer. The method for performing this normalization is to specify a reference point in the signal waveform, and correct the size of the signal waveform so that the size of this reference point is made a reference value. When the signal waveform is a spectral waveform, it is preferable for the reference point to be one selected from the group consisting of the reflectance at a specific wavelength within a specific spectral range, the largest local maximum of reflectance within a specific spectral range, and the maximum reflectance within a specific spectral range, but the reference point is not limited to these. In the example in FIG. 4, the normalization involved setting the local maximum of the signal waveform to a specific reference value (in this case, 1). More specifically, a waveform can be normalized by dividing the signal waveform by a largest local maximum out of the plurality of local maxima. The upper curve in FIG. 4 shows a normalized signal waveform. This normalization of the signal waveform is preferably performed not only when the local maximum or local minimum is extracted as a characteristic quantity, but also in the extraction of all other characteristic quantities, and it is therefore preferable for all the calculations of the extraction of characteristic quantities to be performed for this normalized waveform.

Figure 15A:
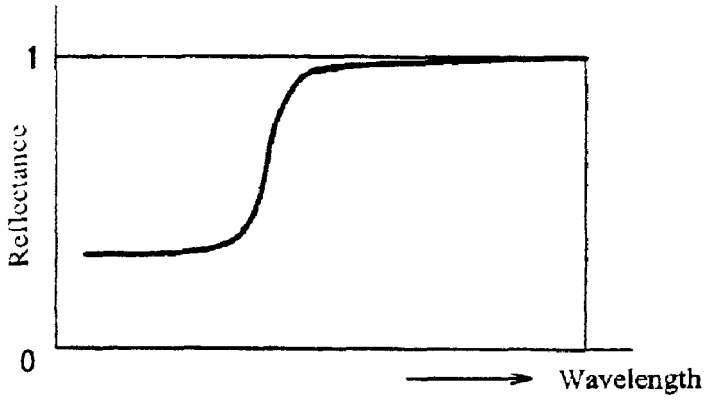
FIGS. 15A, 15B, and 15C are diagrams of the basic rotation of a signal waveform.
Figure 15B:
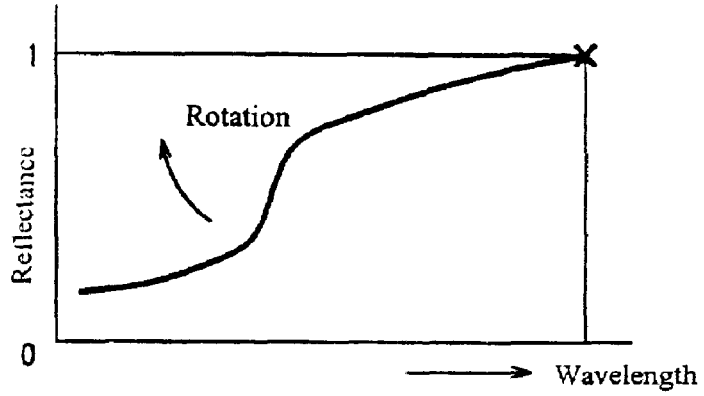
Figure 15C:
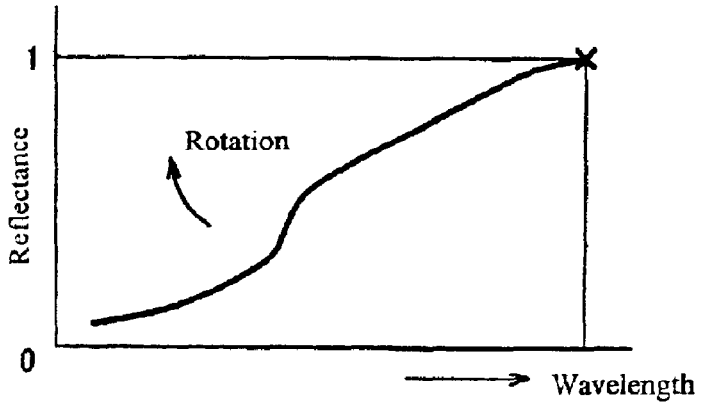

It is also preferable in the extraction of characteristic quantities for the signal waveform to be rotationally corrected around the normalized reference point after the above-mentioned normalization has been performed. The reason for performing this is to remove the effect of the slurry from the signal waveform. Since reflected signal light passes through the slurry, the acquired signal waveform includes a component that has fluctuated through the effect of scattering and so on by the slurry. The amount of fluctuation is proportional to the slurry concentration, and is wavelength dependent. In general, the shorter the wavelength, the greater the fluctuation, so the higher the slurry concentration, the more the signal waveform tends to rise to the right. This is illustrated in FIGS. 15A–C. If the characteristic quantities Sigma and SumPB (discussed below) are extracted when this signal waveform is in the state shown in FIG. 15B or 15C, the values thereof are different from those in FIG. 15A, i.e., when there is no slurry, and furthermore are dependent on slurry concentration. In other words, the size of a characteristic quantity is affected by slurry concentration as well as by layer thickness or other such information inherent to the wafer, and this lowers the precision at which the process end point can be detected. In view of this, the signal waveform is corrected to return the signal waveform to the state in FIG. 15A. The correction method involves rotating the signal around the normalized reference point (the point marked by H in the upper right corner) of the signal waveforms in FIGS. 15B and 15C in the direction in which the tilt is reduced. The tilt here approximates the signal waveform with a linear curve, and is evaluated from the slope thereof. In addition to this rotational method, the rotational correction of the signal waveform can also be performed by measuring the slurry with a separate blank mirror or the like, using the characteristics as reference values, and dividing the signal waveform by the slurry characteristics. Naturally, with this second method, normalization is carried out after this division.

Other characteristic quantities that can be used include the largest local maximum or the smallest local minimum in the signal waveform, local maximum/local minimum values, the largest local maximum/the smallest local minimum, |local maximum−local minimum| for adjacent local maximum/local minimum pairs, a sum of the various |local maximum−local minimum| for a plurality of local maximum/local minimum pairs (that is, Σ |local maximum−local minimum|), an integral value of the signal waveform, a first-order differential coefficient for each of the characteristic quantities, and a second-order differential coefficient for each of the characteristic quantities.

Here, the characteristic quantity obtained as a sum of the various |local maximum−local minimum| for a plurality of the local maximum/local minimum pairs in particular refers to the difference between the local maximum and the local minimum (sum of peak to bottom), and is abbreviated as SumPB. In FIG. 4, SumPB is the total of the index differences between peaks and valleys corresponding to adjacent ◇ and + signs of the normalized waveform, and is found by:

$$((\diamond 1)-(+1))+((\diamond 2)-(+2))+((\diamond 3)-(+3)) \quad (1)$$

Furthermore, the integral value of the signal waveform is abbreviated as Sigma. In FIG. 4, Sigma is the surface area bounded by the normalized waveform, the wavelength axis, and the vertical axis (the reflectance axis).

When the time differential of SumPB or the time differential of Sigma is used as a characteristic quantity, if this is plugged into the case of FIG. 3, the time differential of SumPB is the tilt in SumPB with respect to the normalized signal (only the original signal is shown in FIG. 3) for each signal number, that is, it is the difference in SumPB between adjacent signal numbers (such as between 44 and 45). The time differential of Sigma is the tilt of Sigma with respect to the normalized signal for each signal number, that is, it is thihe difference in Sigma between adjacent signal numbers (such as between 44 and 45).

Figure 13:
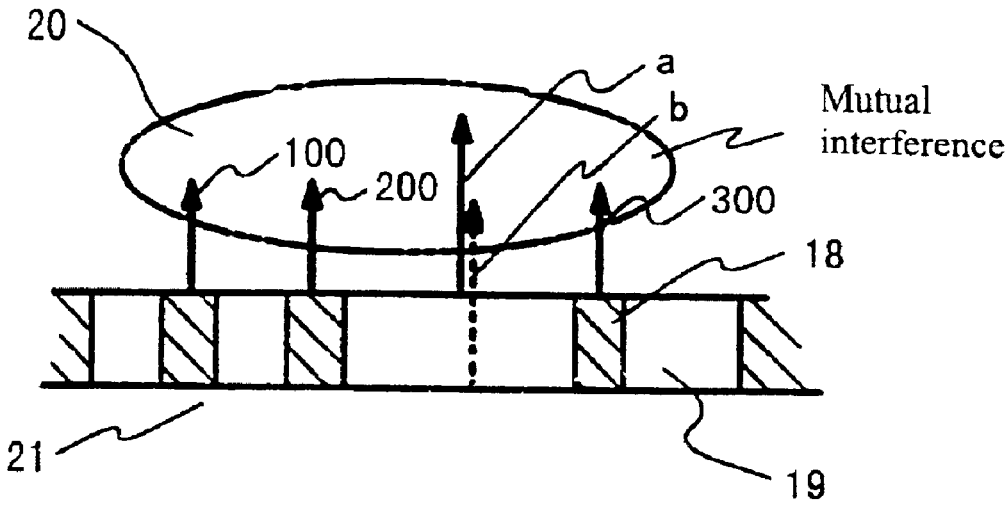
FIG. 13 shows the relationship between the various layers of a device, reflected light waves from the various parts, and the irradiating light spot.

The reflected light from the pattern surface of a semiconductor device wafer can be thought of as an overlay of the light waves from the various portions of each layer of the devices (laminated thin film layers) that make up the pattern, and the spectral waveform of the reflected signal light resulting from this overlay is a complex interference effect, so it is very different from that of a blank film (even if the uppermost layer has the same film thickness). FIG. 13 is a diagram illustrating the concept behind this interference. FIG. 13 shows a section of a device wafer. In FIG. 13, 18 is a metal electrode layer, 19 is a dielectric layer, 21 is an underlayer portion, 20 is an irradiating light spot, and 100, 200, 300, a, and b are the reflected light waves from the various portions of each layer of each of these devices (laminated thin film layers). It is the result of these light waves interfering with one another in a complex fashion that becomes the reflected signal light.

It is generally not an easy matter to directly calculate the layer thickness of the measured object and determine the polishing state from a signal waveform obtained from reflected signal light such as this. Furthermore, in addition to the difficulty of analyzing spectral waveforms, there is the problem of disturbances that impart instability to the spectral waveform.

The number one culprit in these disturbances is the slurry. In the case of FIG. 1, this is the slurry adhering to the top surface of the window plate 15 in the light window 5. The slurry layer through which the irradiating light and the reflected signal light pass fluctuates irregularly in thickness during polishing, and the slurry components also fluctuate irregularly, so this slurry imparts unpredictable noise in the signal waveform.

The number two culprit, as can be seen from FIG. 1, is the disturbance produced when the irradiating light spot irradiates and measures a different position from the previous irradiation position every time the light window cuts off the irradiating light due to the rotation of the platen 4, and performs measurement. This disturbance is generally unavoidable, and imparts unpredictable noise because of the non-uniformity of the remaining layer thickness on the wafer, and because different types of patterns are measured in different positions.

EXAMPLE 1

As discussed above, what is dealt with here is a signal that is difficult to analyze and is affected by disturbance. Accordingly, with the present invention, an attempt was made to extract from a signal waveform a plurality of characteristic quantities with which the polishing state can be ascertained, and to subject these characteristic quantities to logical operation using fuzzy logic.

The following characteristic quantities were used in the fuzzy logic in the present example, but other characteristic quantity groups can also be used, and these are selected on the basis of experimental or logical investigation according to the type of wafer and other factors.

Six characteristic quantities were used in the present example: (1) SumPB, (2) Sigma, (3) the first-order differential coefficient of SumPB, (4) the first-order differential coefficient of Sigma, (5) the second-order differential coefficient of SumPB, and (6) the second-order differential coefficient of Sigma.

There are no particular restrictions on the fuzzy rules, which are suitably selected on the basis of experimental or logical investigation according to the type of wafer and other factors. The following two rules were used in the present example. These rules are linked by "OR" in the fuzzy rules.

Rule 1: The end point is near if (1) is large, and (2) is small, and (3) is small, and (4) is small, and (5) is negative, and (6) is positive; or, Rule 2: The end point is far if (1) is small, or (2) is large, or (3) is large, or (4) is large, or (5) is positive, or (6) is negative.

The "large" and "small" in Rules 1 and 2 are based on the various membership functions. The membership function of SumPB is shown in FIG. 6A, and that of Sigma in FIG. 6B, while the membership function expressions of the above-mentioned fuzzy rules are shown in FIG. 7.

The membership function here is a function indicating the degree of agreement of the ambiguous terms "large" and "small" in the fuzzy rules with respect to the fact of being large or the fact of being small. Furthermore, the fuzzy logic here makes use of the Sugeno system (M. Sugeno, Industrial applications of fuzzy control, Elsevier Science Pub. Co., 1985). This membership function is determined ahead of time on the basis of preliminary experiments, calculation results, and so forth for each characteristic quantity.

Figure 6A:
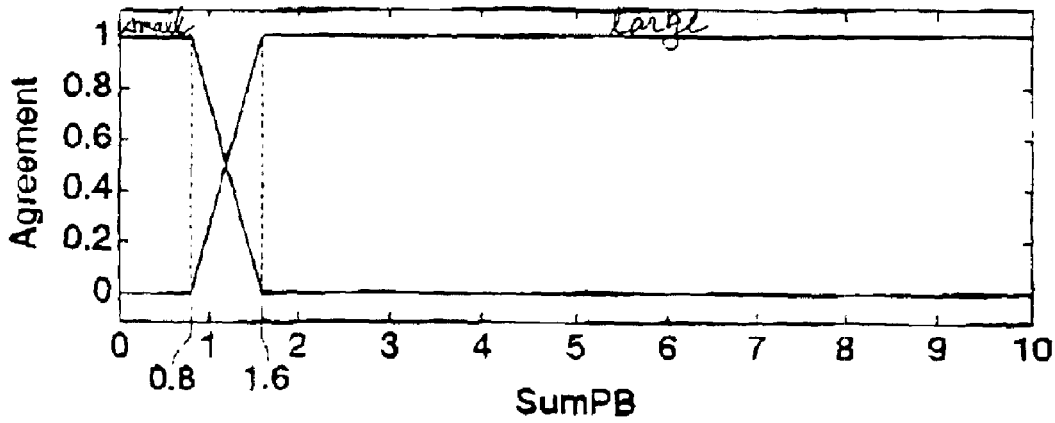
FIGS. 6A and 6B are examples of membership functions of SumPB and Sigma.
Figure 7:
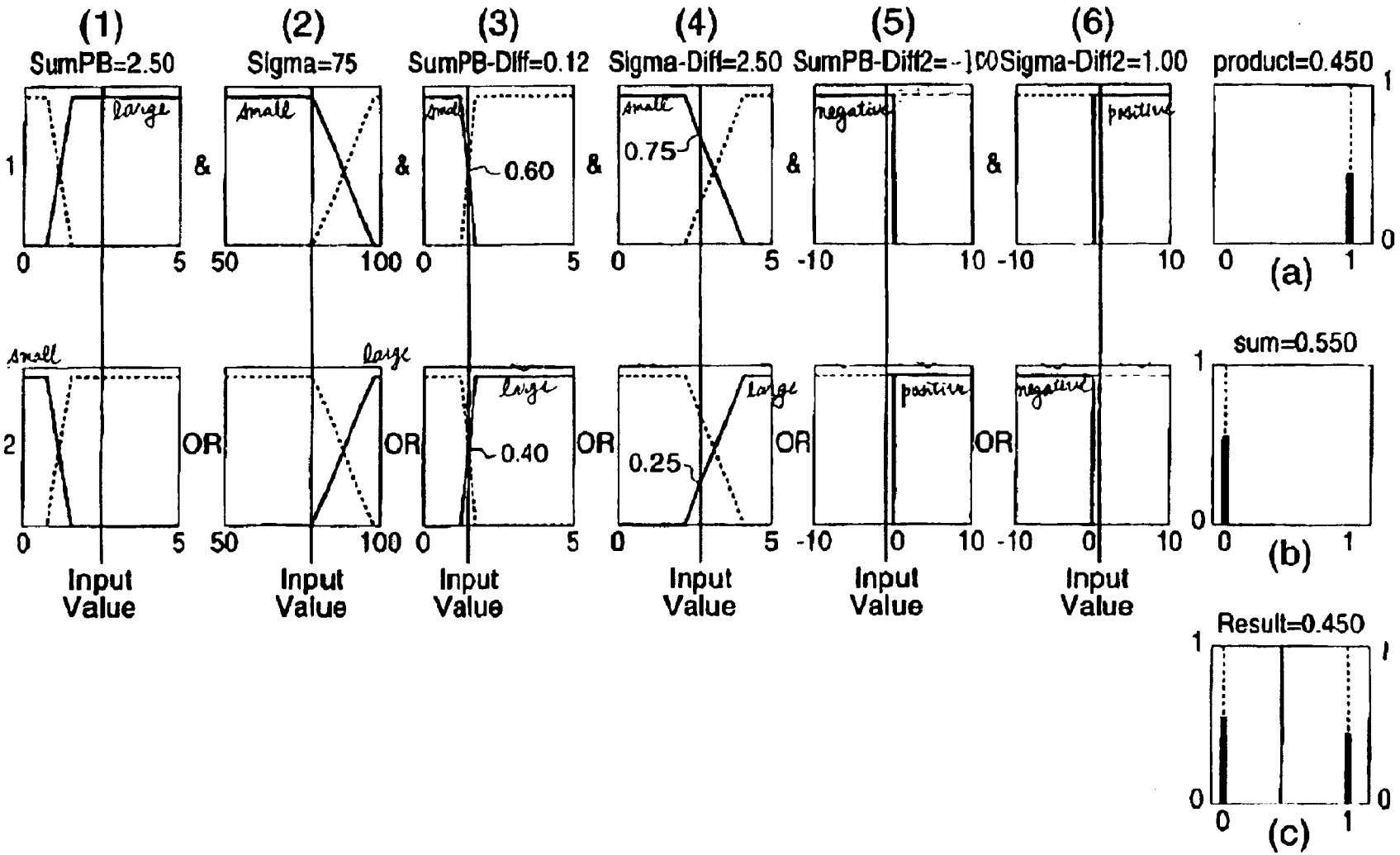
FIG. 7 is an example of membership function expressions of fuzzy rules.

In FIG. 6A, the horizontal axis is the value of SumPB, while the vertical axis is the degree of matching (degree of agreement). The fact that the "large" membership function is 1 and the "small" membership function is 0 when the value of SumPB is at least 1.6 indicates that the agreement between the value of SumPB and "large" is 1 and the agreement with "small" is 0 when the value of SumPB is at least 1.6. Furthermore, the fact that the "small" membership function is 1 and the "large" membership function is 0 when the value of SumPB is 0.8 or less indicates that the agreement between the value of SumPB and "small" is 1 and the agreement with "large" is 0 when the value of SumPB is 0.8 or less. Moreover, when the value of SumPB is over 0.8 and less than 1.6, the agreement with "large" and the agreement with "small" are both values of at least 0 and no more than 1, and this region of SumPB is a region that is neither "large" nor "small."

Figure 6B:
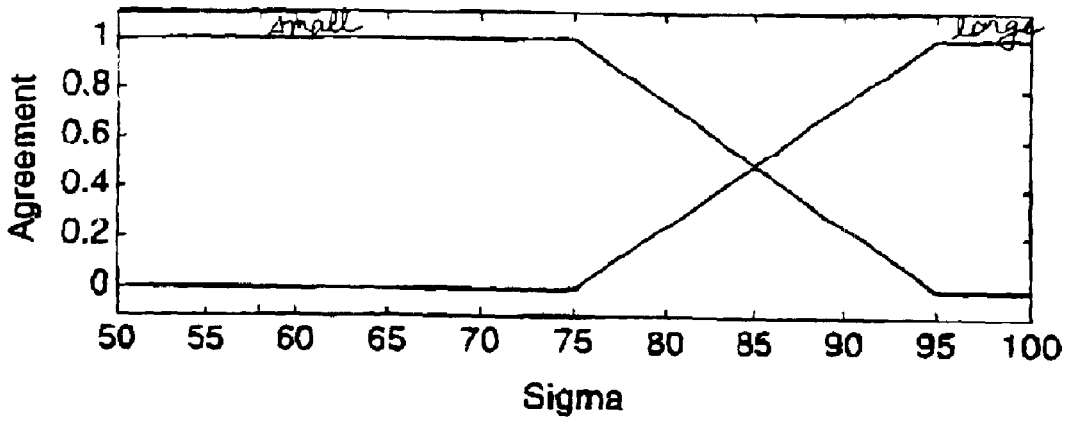

The membership functions of the "small" of Rule 1 and the "large" of Rule 2 are given for Sigma in FIG. 6B, and their meanings should be interpreted in the same way as with SUMPB.

Next, in FIG. 7, (1), (2), (3), (4), (5), and (6) are the respective membership functions of the above-mentioned SumPB, Sigma, first-order differential coefficient of SumPB (SumPB-Diff), first-order differential coefficient of Sigma (Sigma-Diff), second-order differential coefficient of SumPB (SumPB-Diff2), and two-time differential coefficient of Sigma (Sigma-Diff2). Of the two rows above and below, the upper row is for Rule 1 and the lower row is for Rule 2. Here, (1) and (2) express the membership functions in FIGS. 6A and 6B, divided into Rule 1 and Rule 2 and contracted. The horizontal axes are the values of the various characteristic quantities for the various membership functions of (3), (4), (5), and (6), and the vertical axes are the agreement (0-1) with respect to Rule 1 and Rule 2. The straight lines parallel to the vertical axes of the membership functions are input values of the characteristic quantities of (1), (2), (3), (4), (5), and (6) with respect to a given signal number, and are 2.50, 75, 0.12, 2.50, B1.00, and 1.00, respectively. The intersections of these straight lines and the membership functions are the agreement of the various characteristic quantities.

The agreement of (1), (2), (3), (4), (5), and (6) with Rule 1 is 1, 1, 0.60, 0.75, 1, and 1, respectively, and Rule 1 takes the logical product of these. Since an algebraic product is taken as the logical product in the present example, the result of Rule 1 is $1\times1\times0.60\times0.75\times1\times1=0.45$. This result of Rule 1 is given in FIG. 7 as this agreement to 1 of 0.45 when the polishing end point is 1, and this is a membership function of the result of Rule 1.

The agreement of (1), (2), (3), (4), (5), and (6) with Rule 2 is 0, 0, 0.4, 0.25, 0, and 0, respectively, and Rule 2 takes the logical sum of these. An algebraic sum is used as the logical sum, and the result of Rule 2 is $0+0+0.4+0.25+0+0-(0.4\times0.25)=0.55$. This result of Rule 2 is given in FIG. 7 as this agreement to 0 of 0.55 when the complete end point of polishing is 0, and this is a membership function of the result of Rule 2.

Next, FIG. 7 shows the result of rule 1 and the result of Rule 2 expressed together, with the result of Rule 1 and the result of Rule 2 linked by "OR." This is the final result obtained by fuzzy logic, and is again a membership function.

Next, it is preferable to perform defuzzification in order to extract the essence from the membership function in FIG. 7. This defuzzification preferably involves finding the barycenter of the membership function of the final result, but is not limited to this method. When there is a barycentric determination, the following equation gives 0.45, and this value is used as the end point evaluation value at this polishing point in time (signal number).

$$\text{barycenter}=(1\times0.45+0\times0.55)/(0.45+0.55)=0.45 \quad (2)$$

Figure 8:
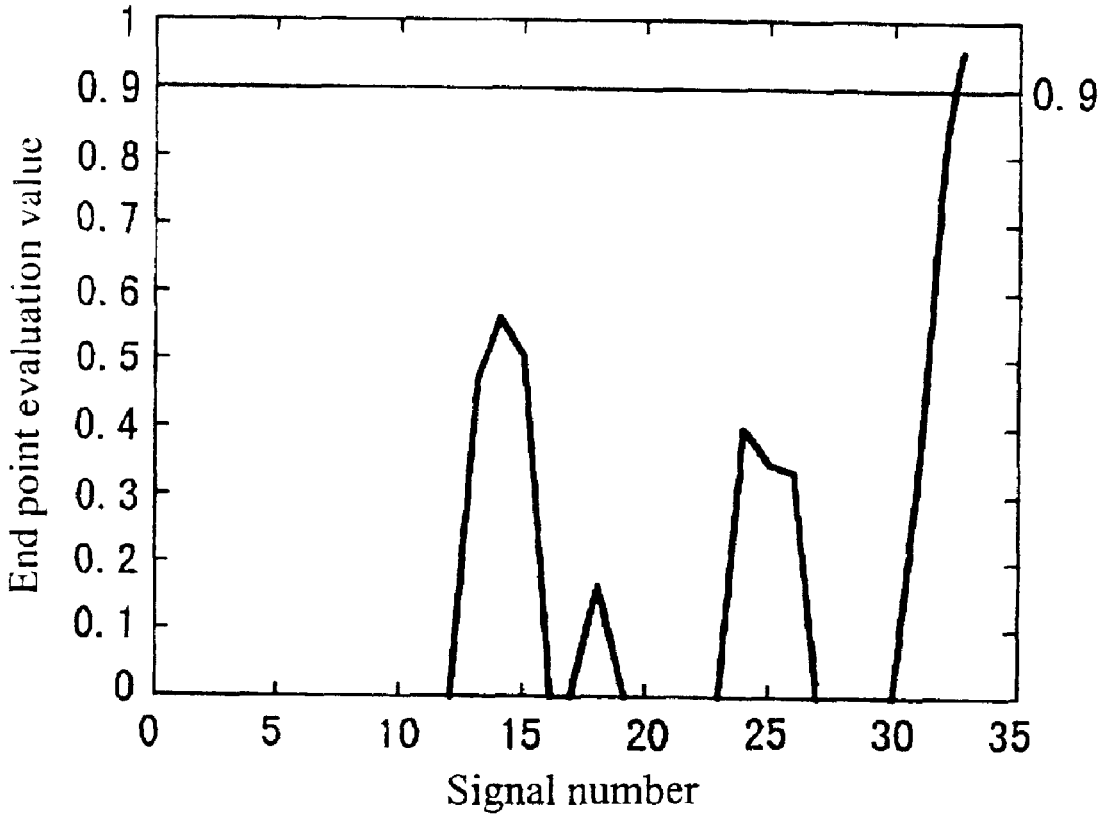
FIG. 8 is a graph of the end point evaluation value versus signal number.

With this fuzzy logic, the nearness of the polishing end point, i.e., the end point evaluation value, is indicated by a value from 0 to 1, and it is known in advance that the polishing end point is when at least 0.9 is reached. In FIG. 8, the horizontal axis is the signal number, while the vertical axis is the end point evaluation value (0 to 1). Since the end point evaluation value is at least 0.9 when the signal number is 33, this is judged to be the polishing end point, and a polishing end point signal can be output.

Figure 9:
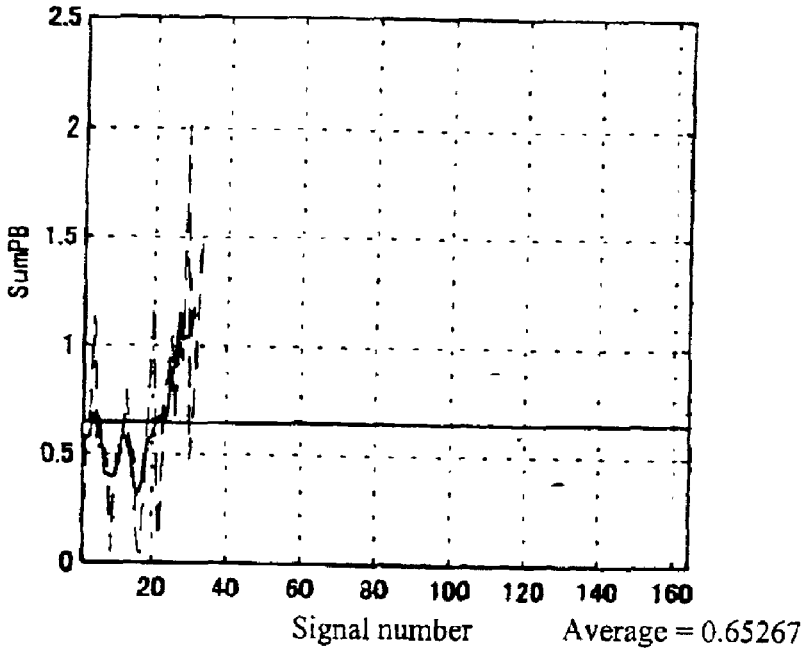
FIG. 9 is a graph of SumPB versus signal number.
Figure 10:
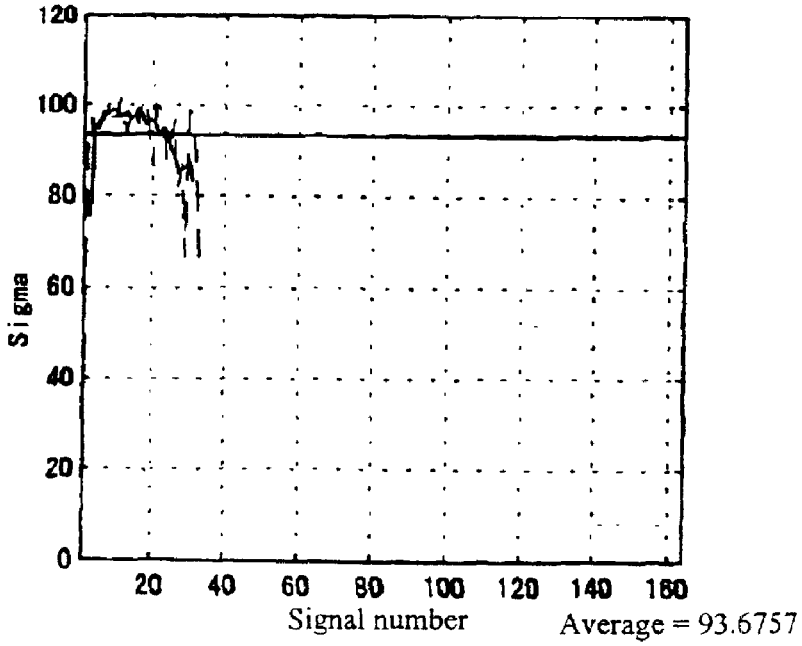
FIG. 10 is a graph of Sigma versus signal number.

Next, the change in the characteristic quantities extracted from the signal waveform, which serve as the basis for performing the above-mentioned fuzzy logic, will be discussed in detail. FIG. 9 is an embodiment of the change in SumPB, in which the horizontal axis is the signal number. The broken line is the value of SumPB, and the solid line is the running mean value of SumPB. FIG. 10 illustrates an embodiment of the change in Sigma. The broken and solid lines and the horizontal axis are the same as in FIG. 9. SumPB and Sigma are both used as a running mean value for input to the fuzzy rule.

Of Rules 1 and 2 for fuzzy logic, the Rule of (1) SumPB being "large" or "small" is a rule that evaluates the magnitude of change in the signal waveform, while the Rule of (2) Sigma being "large" or "small" is a rule that evaluates the overall magnitude of the signal waveform, so these portions can be considered quantitative rules of characteristic quantity evaluation. Meanwhile, (3) the first-order differential coefficient of SumPB, (4) the first-order differential coefficient of Sigma, (5) the second-order differential coefficient of SumPB, and (6) the second-order differential coefficient of Sigma are rules for finding the local maximum and local minimum on the curves of SumPB and Sigma in FIGS. 9 and 10, and can be considered qualitative rules for ascertaining the shape of a curve.

For the quantitative portions (1) and (2), because there is considerable fluctuation in the values depending on the type or condition of the slurry or the type of wafer, it is preferable to perform tuning that laterally shifts the membership functions during measurement according to the changes in the SumPB and Sigma values that occur as polishing proceeds. It is preferable to use the average value of characteristic quantities from the start of polishing up to the time of measurement as a reference value for tuning. The solid lines parallel to the horizontal axis in the graphs of FIGS. 9 and 10 indicate these average values. Thus, if the average value is calculated for SumPB at various measurement stages during polishing, for example, tuning is performed by laterally shifting the membership function in the upper graph of FIG. 6, for instance, so that the agreement of "large" and the agreement of "small" of the membership function of SumPB with respect to this average value are both 0.5. The tuning of the membership function of Sigma is performed by laterally shifting the membership function in the lower graph of FIG. 6 in the same manner as with SumPB.

This tuning allows the membership functions to be suitably selected even when the value of SumPB or Sigma is changed by fluctuation of the slurry, etc.

Thus, with the present invention, two or more characteristic quantities are extracted from a signal waveform, and a logical operation is performed on these characteristic quantities using fuzzy logic, the result of which is that the polishing end point can be detected at high precision and simultaneously with polishing even when the object of measurement is a substrate having a device pattern, or when there is disturbance caused by fluctuation of the slurry or measurement position.

FIG. 16 illustrates the procedure when a computer is used for the signal processing of the signal processor in the above description. The operation of the signal processor will be described below with reference to the step numbers in this figure.

First, when the signal processor is turned on, the CPU 31 in FIG. 5 acquires an optical signal (S1). This optical signal is acquired for every interval of the sampling period.

Next, the CPU 31 extracts characteristic quantities from the optical signal (S2). The characteristic quantities are selected (S10) prior to their extraction. This selection may be made automatically or manually according to the type of wafer, etc.

Next, the CPU 31 tunes the membership functions (S3). Prior to this step S3, the membership functions are determined (S11). This determination may be made automatically or manually according to the type of wafer, etc.

Next, the CPU 31 calculates the various degrees of agreement (S4) to the input values of the characteristic quantities.

Next, the CPU 31 calculates the results of the fuzzy rules (S5).

Prior to this step S5, the fuzzy rules are determined (S12). This determination may be made automatically or manually according to the type of wafer, etc.

Next, the CPU 31 calculates the final results of the fuzzy logic in combination with the results of the various fuzzy rules (S6).

Next, the CPU 31 defuzzifies the final results of the fuzzy logic (S7).

Next, the CPU 31 decides whether the defuzzification value has reached the value predetermined as the process end point (S8).

Prior to step S8, the value of the process end point is set (S13). This setting may be done automatically or manually according to the type of wafer, etc.

If the answer in step S8 is "No", then the CPU 31 processes the next optical signal sampled and acquired.

If the answer in step S8 is "Yes", then the CPU 31 outputs a process end point signal (S9).

In the present example, the polishing end point is detected by means of fuzzy logic using extracted characteristic quantities, so even if there are disturbances in the signal, or if the wafer has been patterned, high-precision and stable detection of the process end point, or simultaneous detection, or both, can be accomplished.

EXAMPLE 2

In Example 1, the polishing end point was detected using fuzzy logic in the logical operation of two or more characteristic quantities, but there are cases where required precision is obtained without fuzzy logic being used, such as when there is little disturbance in the signal waveform, or cases where the use of fuzzy logic may increase the cost because of complicated logical operation. In these cases, fuzzy logic is not used. For instance, instead of the fuzzy Rule 1 with the fuzzy logic described above, the formula for the polishing end point can be an algorithm of a logical operation if the characteristic quantities satisfy all of the conditions so that SumPB is greater than a threshold $S_1$, and Sigma is less than a threshold $S_2$, and the first-order differential coefficient of SumPB is less than a threshold $S_3$, and the first-order differential coefficient of Sigma is less than a threshold $S_4$, and the second-order differential coefficient of SumPB is a negative value, and the second-order differential coefficient of Sigma is a positive value. Here, $S_1$, $S_2$, $S_3$, and $S_4$ are constants determined for each wafer.

FIG. 17 illustrates the procedure when a computer is used for the signal processing of the signal processor in the above description. The operation of the signal processor will be described below with reference to the step numbers in this figure.

First, when the signal processor is turned on, the CPU 31 acquires an optical signal (S31). This optical signal is acquired for every interval of the sampling period.

Next, the CPU 31 extracts characteristic quantities from the optical signal (S32). The characteristic quantities are selected (S36) prior to their extraction. This selection may be made automatically or manually according to the type of wafer, etc.

Next, the CPU 31 performs a logical operation (S33).

Prior to this step S33, the algorithm of the logical operation is determined (S37). This determination may be made automatically or manually according to the type of wafer, etc.

Next, the CPU 31 decides whether the results of the logical operation satisfy the process end point conditions (S34).

If the answer in step S34 is "No", then the CPU 31 processes the next optical signal sampled and acquired.

If the answer in step S34 is "Yes", then the CPU 31 outputs a process end point signal (S35).

In the present example, the polishing end point is detected by means of a logical operation using extracted characteristic quantities, so even if there are disturbances in the signal, or if the wafer has been patterned, high-precision and stable detection of the process end point, or simultaneous detection, or both, can be accomplished, albeit not as well as in Example 1.

EXAMPLE 3

In Examples 1 and 2 above, two or more characteristic quantities were chosen from a signal waveform, and the polishing end point was detected on the basis of logical operations of these, but depending on the type of wafer (type of device pattern), there may be cases where a logical operation is actually undesirable, or cases where performing a logical operation creates a problem in terms of cost. In this case, just one characteristic quantity is chosen, and the change therein is detected. It is favorable for the chosen characteristic quantity to be either the |local maximum−local minimum| for adjacent local maximum/local minimum pairs in the signal waveform (a spectral waveform in this case), a sum of various |local maximum−local minimum| for a plurality of the above-mentioned local maximum/local minimum pairs, or an integral value of the above-mentioned signal waveform. In this case, detection is simplified in the polishing of wafers with a pattern.

FIG. 18 illustrates the procedure when a computer is used for the signal processing of the signal processor in the above description. The operation of the signal processor will be described below with reference to the step numbers in this figure.

First, when the signal processor is turned on, the CPU 31 acquires an optical signal (S41). This optical signal is acquired for every interval of the sampling period.

Next, the CPU 31 extracts a characteristic quantity from the optical signal (S42). The characteristic quantity is selected (S45) prior to its extraction. This selection may be made automatically or manually according to the type of wafer, etc.

Next, the CPU 31 decides whether the characteristic quantity has reached a set value (S43).

Prior to step S43, the value of the process end point is set (S46). This setting may be done automatically or manually according to the type of wafer, etc.

If the answer in step S43 is "No", then the CPU 31 processes the next optical signal sampled and acquired.

If the answer in step S43 is "Yes", then the CPU 31 outputs a process end point signal (S44).

Figure 19:
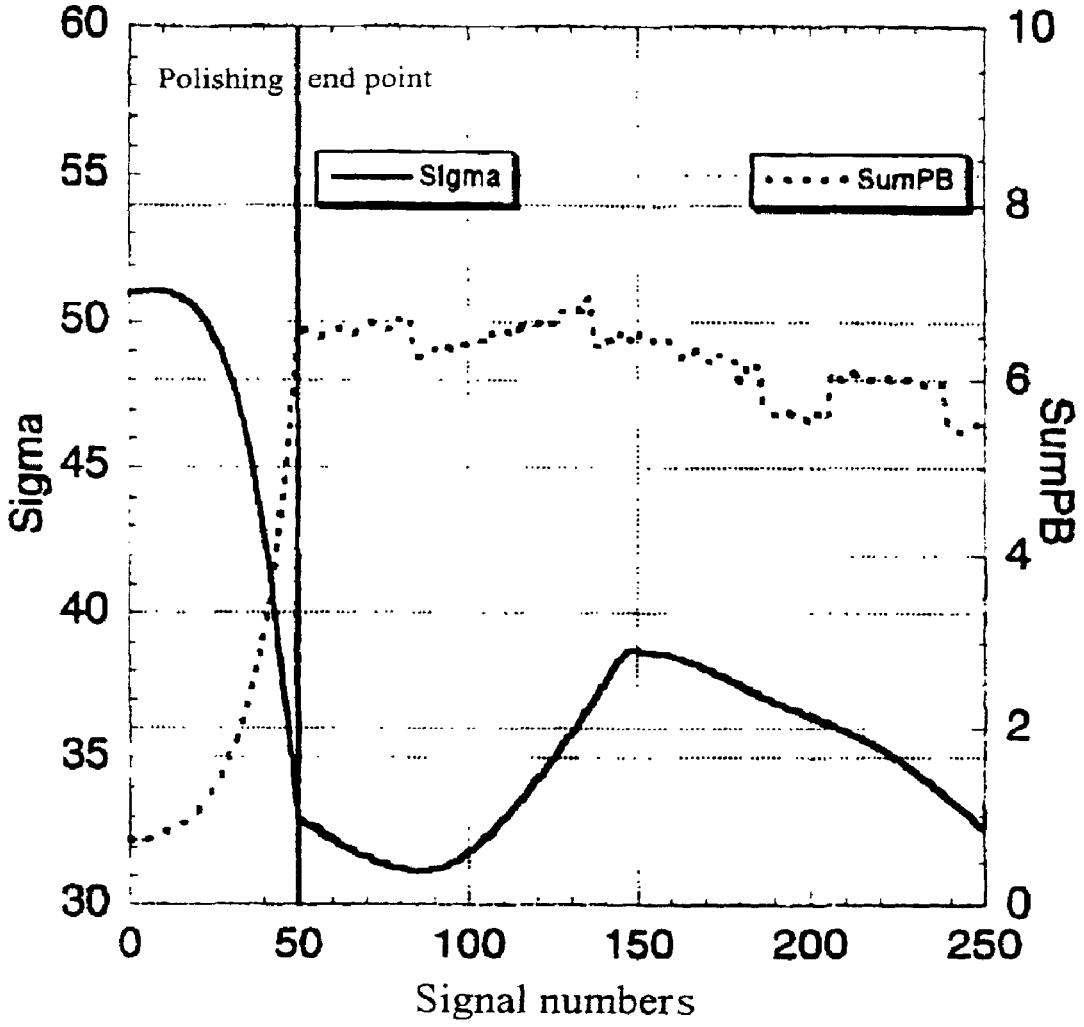
FIG. 19 shows the changes in Sigma and SumPB.

FIG. 19 illustrates an embodiment in which this detection method is employed. FIG. 19 shows the changes in Sigma and SumPB with respect to signal numbers when Sigma and SumPB are selected as characteristic quantities for a TEG (Test Element Groove) pattern. In this embodiment, signal No. 50 corresponds to the polishing end point, at which point Sigma and SumPB both undergo a sharp change in their rate of change, so the polishing end point can be detected by ascertaining the timing at which this occurs. In this case, furthermore, detection of the polishing end point will be even easier if the characteristic quantities (Sigma and SumPB in this case) are subjected to first- or second-order differentiation, so it is preferable for the signal also to undergo a first- or second-order differentiation.

In the present example, the polishing end point is detected from the change in an extracted characteristic quantity, so high-precision and simple detection of the process end point, or simultaneous detection, or both, can be accomplished without requiring the use of a logical operation algorithm or fuzzy logic, and even with a patterned wafer. Moreover, depending on the type of device pattern, the detection can be even more precise than with a logical operation.

A detection apparatus that makes use of the detection methods described in Examples 1, 2, and 3 above can be provided to a polishing apparatus or the like and used in the measurement of a process state.

EXAMPLE 4

The present example relates to a method for manufacturing a semiconductor device using the polishing apparatus of the present invention.

Figure 11:
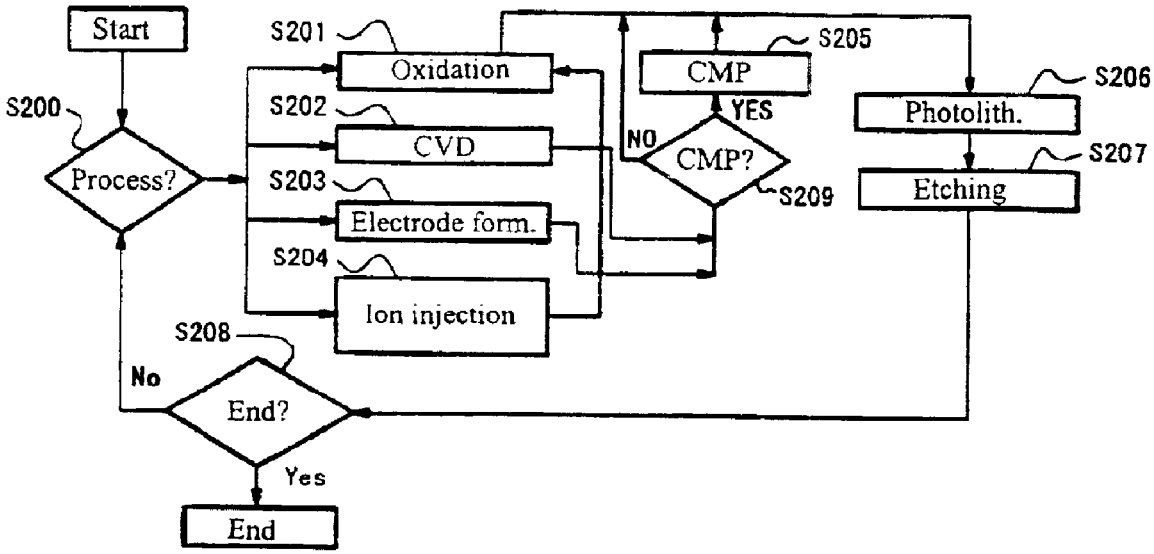
FIG. 11 is a flow chart illustrating an example of a semiconductor device manufacturing process.

FIG. 11 is a flow chart that illustrates the semiconductor device manufacturing process. The semiconductor device manufacturing process starts with step S200, where a suitable processing step is selected from among steps S201 through S204. The flow proceeds to one of steps S201 through S204 as selected.

Step S201 is an oxidation process, in which the surface of a silicon wafer is oxidized. Step S202 is a CVD process, in which an insulating layer is formed on the surface of the silicon wafer by CVD or the like. Step S203 is an electrode layer formation process, in which an electrode layer is formed on the silicon wafer by vapor deposition or another such process. Step S204 is an ion injection process, in which ions are injected into the silicon wafer.

After the CVD process or the electrode layer formation process, the flow proceeds to step S209, where it is decided whether to perform a CMP process. If it is not performed, the flow proceeds to step S206, but if it is performed, the flow proceeds to step S205. Step S205 is a CMP process, in which the polishing apparatus of the present invention is used to perform the planarization of interlayer insulating layers, or the formation of damascene by the polishing of a metal layer on the surface of a semiconductor device, etc.

After the CMP process or the oxidation process, the flow proceeds to step S206. Step S206 is a photolithographic process. This photolithographic process involves coating the silicon wafer with a resist, burning a circuit pattern into the silicon wafer by exposure using an exposure apparatus, and developing the exposed silicon wafer. The following step S207 is an etching process, in which the portion outside the developed resist image is removed by etching, after which the resist is peeled off to remove the resist, which is no longer necessary after etching is completed.

Next, a decision is made in step S208 as to whether all of the required processes have been completed. If they have not been completed, the flow returns to step S200, the previous steps are repeated, and a circuit pattern is formed on the silicon wafer. If it is determined in step S208 that all of the processes have been completed, the flow is ended.

With the semiconductor device manufacturing method pertaining to the present invention, because the polishing apparatus pertaining to the present invention is used in the CMP process, the polishing end point is detected more precisely in this CMP process, which boosts the yield of the CMP process. As a result, a semiconductor device can be manufactured at a lower cost than with a conventional semiconductor device manufacturing method.

The present invention can also be used in the CMP process of other semiconductor device manufacturing processes besides the semiconductor device manufacturing process shown in FIG. 11.

The semiconductor device pertaining to the present invention is manufactured by the semiconductor device manufacturing method pertaining to the present invention. This allows a semiconductor device to be manufactured at a higher level of quality and a lower cost than with a conventional semiconductor device manufacturing method, and affords a decrease in the cost of manufacturing a semiconductor device.

The inventions of Examples 1, 2, 3, and 4 were described above, but functions enabling two or more of the detection methods selected from among the various signal processing methods of Examples 1, 2, and 3 may be combined in a single detection apparatus, and one of these functions may be selected in carrying out the detection. This allows the detection method that is best suited to the type of wafer and the polishing conditions to be selected.

Furthermore, the present invention includes not only a case in which the detection is performed through a light window as in FIG. 1, but also one in which the polishing head is able to swing as well as rotate, the wafer is allowed to stick out from the polishing pad, and this protruding portion is irradiated with light for the purpose of detection. In this case, there is no need for a light window. Furthermore, with a polishing apparatus in which the polishing pad is smaller than the wafer, the exposed portion of the wafer protruding from the polishing pad can be used for detection.

The present invention can be used not only for detecting the polishing end point, but also the process end point in other removal processes such as ion etching, etc., or in film formation processes such as CVD and sputtering, etc. The "process end point" referred to here includes not only the point of completion of the process in a standard thin film layer removal process, for example, but also the end point of intermediate steps such as the timing at which a removal process moves on to a different material layer, etc.

The detection apparatus in FIG. 1 directs light from the patterned side of the semiconductor device, but light can also be directed from the back of the wafer. In this case, a multiple wavelength component light source in the infrared band will be needed for the light source.

The present invention was described above through reference to the drawings, but the scope of the present invention is not limited to the scope depicted by these drawings, nor is the present invention limited to the above description.

What is claimed is:

1. A detection apparatus for detecting a process end point in one of a layer formation process for forming one of a metal electrode layer and an insulating layer on a substrate, and in a removal process for a layer, from a signal waveform obtained by irradiating a substrate face with light of multiple wavelength components and detecting at least one of a reflected signal light and a transmitted signal light; the detection apparatus comprises:

a characteristic quantity extraction component for extracting two or more characteristic quantities from the signal waveform, and a logical operation component for using the two or more characteristic quantities to perform a logical operation and determine the process end point, wherein the signal waveform is a spectral waveform.

2. A detection apparatus for detecting a process end point in one of a layer formation process for forming one of a metal electrode layer and an insulating layer on a substrate, and in a removal process for a layer, from a signal waveform obtained by irradiating a substrate face with light and detecting at least one of a reflected signal light and a transmitted signal light; the detection apparatus comprises:

a characteristic quantity extraction component for extracting two or more characteristic quantities from the signal waveform, and a logical operation component for using the two or more characteristic quantities to perform a logical operation and determine the process end point, wherein the signal waveform is a spectral waveform, and the characteristic quantities are selected from a characteristic quantity group consisting of local maxima in the signal waveform, a largest local maximum, local minima, a smallest local minimum, local maximum/local minimum values, a largest local maximum/a smallest local minimum, |local maximum−local minimum| for adjacent local maximum/local minimum pairs, a sum of various |local maximum−local minimum| for a plurality of local maximum/local minimum pairs, an integral value of the signal waveform, a group of first-order and second-order time differential coefficients for each of the characteristic quantities, and a group of positive and negative signs of the time differential coefficients.

3. The detection apparatus of claim 1, wherein the logical operation component makes its determination using fuzzy logic.

4. The detection apparatus of claim 2, wherein the logical operation component makes its determination using fuzzy logic.

5. The detection apparatus of claim 3, where membership functions used in the fuzzy logic are tuned during detection by means of values computed from the characteristic quantities.

6. The detection apparatus of claim 4, where membership functions used in the fuzzy logic are tuned during detection by means of values computed from the characteristic quantities.

7. A detection apparatus for detecting a process end point in one of a layer formation process for forming one of a metal electrode layer and an insulating layer on a substrate, and in a removal process for a layer, from a change in a characteristic quantity extracted from a signal waveform obtained by irradiating a substrate face with light and detecting at least one of a reflected signal light and a transmitted signal light; the detection apparatus comprises:

a characteristic quantity extraction component for extracting a characteristic quantity from the signal waveform, wherein the signal waveform is a spectral waveform, and wherein the characteristic quantity is one of a |local maximum−local minimum| for adjacent local maximum/local minimum pairs in the signal waveform, a sum of various |local maximum−local minimum| for a plurality of local maximum/local minimum pairs, and an integral value of the signal waveform.

8. The detection apparatus of claim 1, wherein the characteristic quantities are extracted from a waveform in which the signal waveform has been normalized.

9. The detection apparatus of claim 7, wherein the characteristic quantities are extracted from a waveform in which the signal waveform has been normalized.

10. The detection apparatus of claim 1, wherein the characteristic quantities are extracted from a waveform in which the signal waveform has undergone rotational correction.

11. The detection apparatus of claim 7, wherein the characteristic quantities are extracted from a waveform in which the signal waveform has undergone rotational correction.

12. The detection apparatus of claim 8, wherein the characteristic quantities are extracted from a waveform in which the signal waveform has undergone rotational correction.

13. A polishing apparatus equipped with a holder for holding a substrate, a polishing body, and a detection apparatus of claim 1, wherein the detection apparatus detects a process end point when the substrate is polished by applying a load between the substrate and the polishing body and causing relative motion between the substrate and the polishing body in a state in which a polishing agent has been interposed between the substrate and the polishing body.

14. A polishing apparatus equipped with a holder for holding a substrate, a polishing body, and a detection apparatus of claim 7, wherein the detection apparatus detects a process end point when the substrate is polished by applying a load between the substrate and the polishing body and causing relative motion between the substrate and the polishing body in a state in which a polishing agent has been interposed between the substrate and the polishing body.

15. A polishing apparatus equipped with a holder for holding a substrate, a polishing body, and a detection apparatus of claim 8, wherein the detection apparatus detects a process end point when the substrate is polished by applying a load between the substrate and the polishing body and causing relative motion between the substrate and the polishing body in a state in which a polishing agent has been interposed between the substrate and the polishing body.

16. A method for manufacturing a semiconductor device comprising a stage in which a polishing apparatus of claim 13 is used to polish a surface of a semiconductor wafer.

17. A method for manufacturing a semiconductor device comprising a stage in which a polishing apparatus of claim 14, is used to polish a surface of a semiconductor wafer.

18. A method for manufacturing a semiconductor device comprising a stage in which a polishing apparatus of claim 15, is used to polish a surface of a semiconductor wafer.

19. A machine readable recording medium on which is recorded a signal processing program for causing a computer to function as the characteristic quantity extraction component and the logical operation component, according to claim 7.

20. A machine readable recording medium on which is recorded a signal processing program for causing a computer to function as the characteristic quantity extraction component and the logical operation component, according to claim 2.

21. A machine readable recording medium on which is recorded a signal processing program for causing a computer to function as the characteristic quantity extraction component and the logical operation component, according to claim 8.

22. A machine readable recording medium on which is recorded a signal processing program for causing a computer to function as the characteristic quantity extraction component and the logical operation component, according to claim 10.

23. A detection method for detecting a process end point in one of a layer formation process for forming one of a metal electrode layer and an insulating layer on a substrate, and in a removal process for a layer, from a signal waveform obtained by irradiating a substrate face with light and detecting at least one of a reflected signal light and a transmitted signal light; the detection method comprises:

a first stage in which two or more characteristic quantities are extracted from the signal waveform, and a second stage in which the two or more characteristic quantities are used to perform a logical operation and determination.

24. A detection method for detecting a process end point in one of a layer formation process for forming one of a metal electrode layer and an insulating layer on a substrate, and in a removal process for a layer, from a change in a characteristic quantity extracted from a signal waveform obtained by irradiating a substrate face with light and detecting at least one of a reflected signal light and a transmitted signal light, wherein the signal waveform is a spectral waveform, and the characteristic quantity is one of |local maximum−local minimum| for adjacent local maximum/local minimum pairs in the signal waveform, a sum of various |local maximum−local minimum| for a plurality of local maximum/local minimum pairs, and an integral value of the signal waveform.

* * * * *